US012678012B2

(12) United States Patent
Kim et al.

(10) Patent No.: US 12,678,012 B2
(45) Date of Patent: Jul. 14, 2026

(54) DISHWASHER

(71) Applicant: LG ELECTRONICS INC., Seoul (KR)

(72) Inventors: Seung Hun Kim, Seoul (KR); Gyu Han Hwang, Seoul (KR); Chang Yoon Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 142 days.

(21) Appl. No.: 18/636,558

(22) Filed: Apr. 16, 2024

(65) Prior Publication Data

US 2024/0341562 A1 Oct. 17, 2024

(30) Foreign Application Priority Data

Apr. 17, 2023 (KR) ..... 10-2023-0050084
Feb. 13, 2024 (KR) ..... 10-2024-0020157

(51) Int. Cl.
*A47L 15/42* (2006.01)
*A47L 15/48* (2006.01)

(52) U.S. Cl.
CPC ..... *A47L 15/4209* (2016.11); *A47L 15/481* (2013.01); *A47L 2401/34* (2013.01)

(58) Field of Classification Search
None
See application file for complete search history.

(56) References Cited

U.S. PATENT DOCUMENTS

| | | | |
|---|---|---|---|
| 8,858,727 | B2 | 10/2014 | Jerg et al. |
| 2011/0114136 | A1 | 5/2011 | Jerg et al. |
| 2011/0114137 | A1 | 5/2011 | Jerg et al. |

FOREIGN PATENT DOCUMENTS

| | | | |
|---|---|---|---|
| EP | 1667569 | A1 | 6/2006 |
| EP | 1833353 | A1 | 9/2007 |
| EP | 2312988 | A2 | 4/2011 |
| EP | 2326233 | A2 | 6/2011 |
| EP | 2326235 | A1 | 6/2011 |
| EP | 2323537 | B1 | 12/2014 |
| WO | 2013050541 | A1 | 4/2013 |

OTHER PUBLICATIONS

Extended European Search Report in European Appln No. 24170466.7, mailed on Sep. 30, 2024, 10 pages.

*Primary Examiner* — Levon J Shahinian
(74) *Attorney, Agent, or Firm* — Fish & Richardson P.C.

(57) ABSTRACT

A dishwasher has a first predetermined separation space defined between a heater housing and a main housing, to provide a heat insulation air layer for a heater and a heater housing, thereby minimizing a release of heat of the heater to the outside of the main housing and ensuring improvement in energy efficiency.

19 Claims, 25 Drawing Sheets

DISHWASHER

CROSS-REFERENCE TO RELATED APPLICATION

This application claims priority to and benefit of Korean Patent Application No. 10-2023-0050084, filed on Apr. 17, 2023, and No. 10-2024-0020157, filed on Feb. 13, 2024, which is hereby incorporated by reference as when fully set forth herein.

TECHNICAL FIELD

The present disclosure relates to a dishwasher, and in particular, a dishwasher in which a first predetermined separation space is formed between a heater housing and a main housing, to form a heat insulation air layer for a heater and the heater housing, thereby minimizing a release of heat of the heater to the outside of the main housing and ensuring improvement in energy efficiency.

BACKGROUND

Dishwashers spray wash water such as water to a wash target stored therein such as kitchenware, cooling tools and the like and wash the wash target. The wash water used for a wash may comprise detergent.

Ordinarily, a dishwasher comprises a wash tub configured to form a wash space, a storage part disposed in the wash tub and configured to accommodate a wash target, a spray arm configured to spray wash water to the storage part, and a sump configured to store water and to supply wash water to the spray arm.

Such a dishwasher may help to reduce time and efforts spent washing a wash target such as kitchenware and the like after meals, enhancing user convenience.

Ordinarily, a dishwasher may perform a washing procedure of washing wash targets, a rinsing procedure of rinsing wash targets, and a drying procedure of drying wash targets that are washed and rinsed completely.

In recent years, a dishwasher with a moisture absorbing device has been launched, and the dishwasher absorbs water vapor included in air discharged from a tub during the drying procedure and then supplies the air to the tub again to reduce time taken to dry a wash target.

An absorbent provided at the moisture absorbing device may experience a moisture absorbing process in which moisture in an air current is absorbed while the drying procedure is performed, and a reproducing process in which the absorbent is exposed to a high-temperature air current and dried after the drying procedure is completed.

The moisture absorbing device may be provided with a heater for heating an air current during the reproducing process.

As a related art, a dishwasher in which a heater is used to form a high-temperature air current for reproducing an absorbent during a washing procedure is disclosed in EU Patent Registration No. 2326233 (prior art document 001).

In the case of a dishwasher according to prior art document 001, a heater without a case is accommodated in an inner passage of a housing accommodating the absorbent or in an air supply duct connected to the housing.

In the configuration disclosed in prior art document 001, since the housing or the air supply duct is highly likely to be directly affected by heat generated by the heater, the housing or the air supply duct may be deformed or damaged by the heat generated by the heater unless the housing or the air supply duct is made of a material having predetermined heat resistance, and in the case where the housing or the air supply duct is made of a material having predetermined heat resistance, the manufacturing costs of the housing or the air supply duct increase.

Further, in the configuration disclosed in prior art document 001, since no additional heat insulation means is provided to the outside of the housing or the air supply duct, at least a portion of heat generated by the heater is released outward, power consumption increases and energy efficiency deteriorates to maintain the temperature of an air current to be supplied to the absorbent at a certain level or above.

PRIOR ART DOCUMENT

Patent Document (Patent Document 001) EU Patent No. 2326233

SUMMARY

Technical Problems

The first objective of the present disclosure is to provide a dishwasher in which a heater in the state of being accommodated in a heater housing having predetermined heat resistance is accommodated in a main housing, such that damage or deformation to the main housing, caused by heat generated by the heater, is minimized.

The second objective of the present disclosure is to provide a dishwasher in which a first predetermined separation space is formed between the heater housing and the main housing, such that a heat insulation air layer is formed for the heater and the heater housing, thereby minimizing a release of heat of the heater to the outside of the main housing and ensuring improvement in energy efficiency.

The third objective of the present disclosure is to provide a dishwasher in which a sub housing is attached to the outer portion of the main housing, and a second predetermined separation space is formed between the main hosing and the sub housing, such that the second separation space acts as a heat insulation air layer for an absorbent as well as acting as an air heat insulation layer for the heater and the heater housing, thereby ensuring improvement in reproduction efficiency of the absorbent and ensuring a reduction in manufacturing costs and a simplification of manufacturing processes with no need to add a heat insulation material.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

According to the present disclosure, a dishwasher comprises a tub configured to form a wash space and to accommodate kitchenware; and a moisture-absorbing and drying device configured to absorb moisture from air discharged from the tub and to supply the air to the tub, the moisture-absorbing and drying device may comprise an air blowing fan configured to make the air flow and to form an air current; an absorbent disposed in a lower stream of the air blowing fan with respect to a flow direction of the air current; a heater disposed between the air blowing fan and the absorbent with respect to the flow direction of the air current. and configured to heat an air current to be supplied to the absorbent; a heater housing configured to accommodate the heater; and a main housing configured to accommodate the heater housing and the absorbent, and a first separation space may be formed between the heater housing and an inner surface of the main housing.

The first separation space may comprise a lower separation space formed between a lower surface of the heater housing and a bottom surface part of the main housing.

Additionally, a first bead forming part protruding toward the bottom surface part of the main housing may be provided on the lower surface of the heater housing, and the lower surface of the heater housing may be supported by the first bead forming part in a state where the lower surface of the heater housing is spaced upward from the bottom surface part of the main housing.

Further, a bead groove into which the first bead forming part is inserted and which is depressed from the bottom surface part of the main housing may be provided at the bottom surface part of the main housing.

The first separation space may comprise a front separation space formed between a front surface of the heater housing and a front surface part of the main housing.

The first separation space may comprise a rear separation space formed between a rear surface of the heater housing and a rear surface part of the main housing.

The dishwasher may further comprise a cover disposed at an upper side of the heater housing, and coupled to an open upper surface of the main housing, a second separation space may be formed between the cover and an upper surface of the heater housing, and the second separation space may communicate with the first separation space.

Further, a second bead forming part protruding toward the cover may be provided on the upper surface of the heater housing, and the second bead forming part may keep the upper surface of the heater housing and the cover spaced from each other.

Further, a ring-shaped first rib into which the second bead forming part is inserted and which protrudes toward the upper surface of the heater housing may be provided at the cover.

The moisture-absorbing and drying device may further comprise a thermostat for sensing overheating of the heater, a penetration hole into which the thermostat is inserted may be provided at the cover, and a second rib configured to extend along an edge of the penetration hole and to protrude toward the upper surface of the heater housing may be provided in a lower portion the penetration hole.

Further, a sealing ring made of an elastic material may be provided between the penetration hole and the thermostat.

The moisture-absorbing and drying device may further comprise a sub housing coupled to an outer surface of the main housing, and a third separation space may be formed between the sub housing and the outer surface of the main housing.

The sub housing may comprise a protrusion rib configured to protrude toward the outer surface of the main housing and to contact the outer surface of the main housing, and a thickness of the third separation space may be a height at which the protrusion rib protrudes from an inner surface of the sub housing.

The third separation space may be a closed space that is closed by the protrusion rib, the inner surface of the sub housing and the outer surface of the main housing.

According to the present disclosure, a dishwasher comprises a tub configured to form a wash space and to accommodate kitchenware; and a moisture-absorbing and drying device configured to absorb moisture from air discharged from the tub and to supply the air to the tub, the moisture-absorbing and drying device may comprise an air blowing fan configured to make the air flow and to form an air current; an absorbent disposed in a lower stream of the air blowing fan with respect to a flow direction of the air current; a main housing configured to accommodate the absorbent; and a sub housing coupled to an outer surface of the main housing, the absorbent may be accommodated in a double structure formed by the main housing and the sub housing, and a separation space may be formed between the main housing and the sub housing.

The sub housing may comprise a protrusion rib configured to protrude toward the outer surface of the main housing, and to contact the outer surface of the main housing, and a thickness of the separation space may be a height at which the protrusion rib protrudes from an inner surface of the sub housing.

The moisture-absorbing and drying device may further comprise a heater disposed between the air blowing fan and the absorbent with respect to a flow direction of the air current, and configured to heat an air current to be supplied to the absorbent, and the heater may be accommodated in the double structure.

The moisture-absorbing and drying device may further comprise a heater housing configured to accommodate the heater, and disposed in the main housing, and an inner separation space may be formed between the heater housing and the main housing.

According to the present disclosure, a dishwasher comprises a tub configured to form a wash space and to accommodate kitchenware; and a moisture-absorbing and drying device configured to absorb moisture from air discharged from the tub and to supply the air to the tub, the moisture-absorbing and drying device may comprise an air blowing fan configured to make the air flow and to form an air current; an absorbent disposed in a lower stream of the air blowing fan with respect to a flow direction of the air current; a heater disposed between the air blowing fan and the absorbent with respect to the flow direction of the air current, and configured to heat an air current to be supplied to the absorbent; a heater housing configured to accommodate the heater; a main housing configured to accommodate the heater housing; and a sub housing coupled to an outer surface of the main housing, and the heater may be accommodated in a triple structure formed by the heater housing, the main housing and the sub housing.

The moisture-absorbing and drying device may further comprise an absorbent holder configured to prevent the absorbent together with the heater housing accommodated in the main housing from escaping from the main housing, and the absorbent holder together with the absorbent may be accommodated in a double structure formed by the main housing and the sub housing.

According to the present disclosure, a dishwasher comprises a tub configured to form a wash space and to accommodate kitchenware; and a moisture-absorbing and drying device configured to absorb moisture from air discharged from the tub and to supply the air to the tub, the moisture-absorbing and drying device may comprise an air blowing fan configured to make the air flow and to form an air current; an absorbent disposed in a lower stream of the air blowing fan with respect to a flow direction of the air current; a heater disposed between the air blowing fan and the absorbent with respect to the flow direction of the air current, and configured to heat an air current to be supplied to the absorbent; a heater housing configured to accommodate the heater; a main housing configured to accommodate the heater housing and the absorbent; and a sub housing coupled to an outer surface of the main housing, and a separation space may respectively formed between the heater housing and the inner surface of the main housing and between the sub housing and the outer surface of the main housing.

Advantageous Effects

The dishwasher of the present disclosure may produce the effect of minimizing damage or deformation to the main housing, caused by heat generated by a heater, since the heater in the state of being accommodated in a heater housing having predetermined heat resistance is accommodated in a main housing.

The dishwasher of the present disclosure may produce the effects of minimizing a release of heat of the heater to the outside of the main housing and enhancing energy efficiency, since a first predetermined separation space is formed between the heater housing and the main housing, to form a heat insulation air layer for the heater and the heater housing.

The dishwasher of the present disclosure may produce the effects of ensuring improvement in reproduction efficiency of an absorbent and ensuring a reduction in manufacturing costs and a simplification of manufacturing processes with no need to add a heat insulation material, since a sub housing is attached to the outer portion of the main housing, and a second predetermined separation space is formed between the main hosing and the sub housing, such that the second separation space acts as a heat insulation air layer for an absorbent as well as acting as an air heat insulation layer for the heater and the heater housing.

Specific effects are described in the section of detailed description along with the above-described effects.

BRIEF DESCRIPTION OF DRAWINGS

The accompanying drawings constitute a part of the specification, illustrate one or more embodiments in the disclosure, and together with the specification, explain the disclosure.

DETAILED DESCRIPTION

Figure 1:
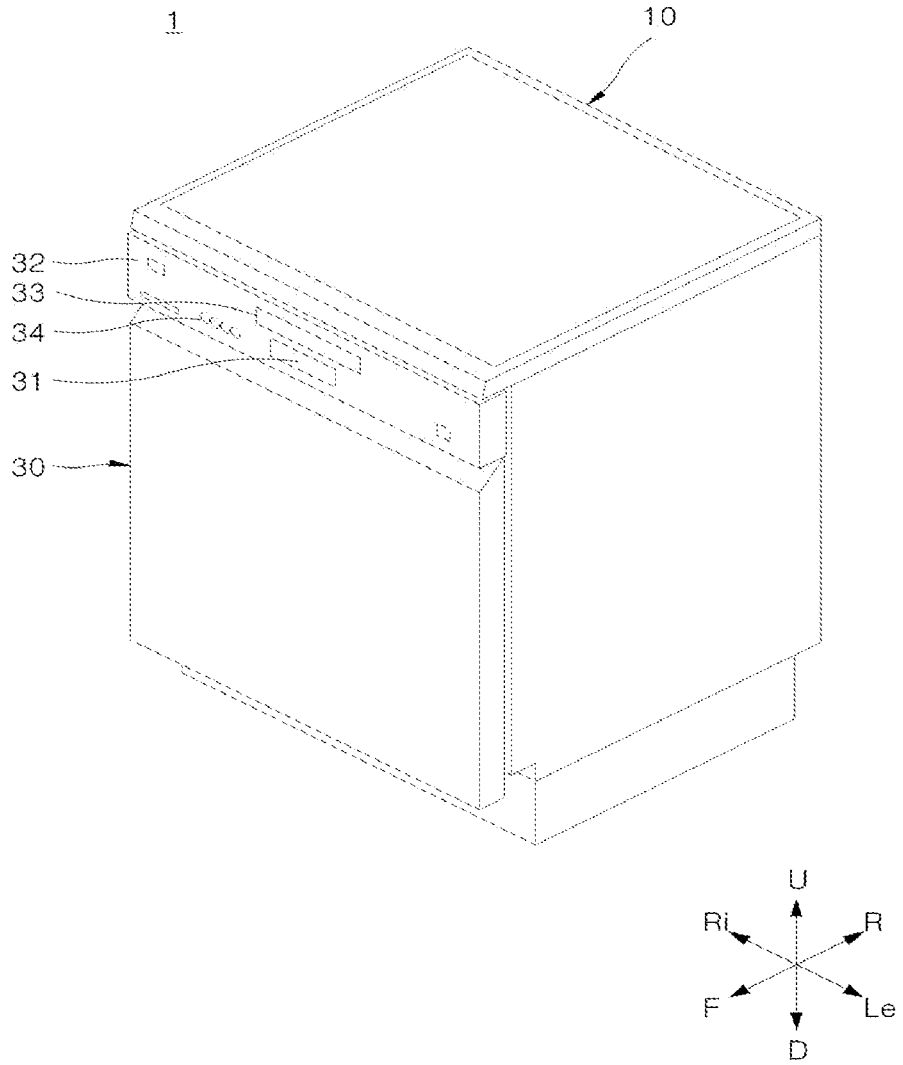
FIG. 1 is a front perspective view showing a dishwasher of one embodiment.

The above-described aspects, features and advantages are specifically described hereinafter with reference to accompanying drawings such that one having ordinary skill in the art to which the subject matter of the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereinafter, preferred embodiments according to the disclosure are specifically described with reference to the accompanying drawings. In the drawings, identical reference numerals denote identical or similar components.

The terms "first", "second" and the like are used herein only to distinguish one component from another component, but the components are not to be limited by the terms. Certainly, a first component can be a second component, unless stated to the contrary.

In the disclosure, each component may be provided as a single one or a plurality of ones, unless explicitly indicated otherwise.

When any one component is described as being "in the upper portion (or the lower portion)" or "on (or under)" another component, any one component can be directly on (or under) another component, and an additional component can be interposed between the two components.

When any one component is described as being "connected", "coupled" or "connected" to another component, any one component can be directly connected or coupled to another component, but an additional component can be "interposed" between the two components, or the two components can be "connected", "coupled" or "connected" by an additional component.

In the disclosure, singular forms include plural forms as well, unless explicitly indicated otherwise. In the disclosure, the terms "comprised of", "comprise", and the like do not imply necessarily including stated components or stated steps, and imply excluding some of the stated components or stated steps or including additional components or additional steps.

In the disclosure, singular forms include plural forms as well, unless explicitly indicated otherwise. In the disclosure, the terms "comprised of", "comprise", and the like do not imply necessarily including stated components or stated steps, and imply excluding some of the stated components or stated steps or including additional components or additional steps.

Throughout the disclosure, the terms "A and/or B" as used herein can denote A, B or A and B, and the terms "C to D" can denote C or greater and D or less, unless stated to the contrary.

Hereinafter, the subject matter of the present disclosure is described with reference to the drawings illustrating the configuration of one embodiment.

[Entire Structure of Dishwasher]

Hereinafter, the entire structure of a dishwasher 1 of one embodiment is specifically described with reference to the accompanying drawings.

Figure 2:
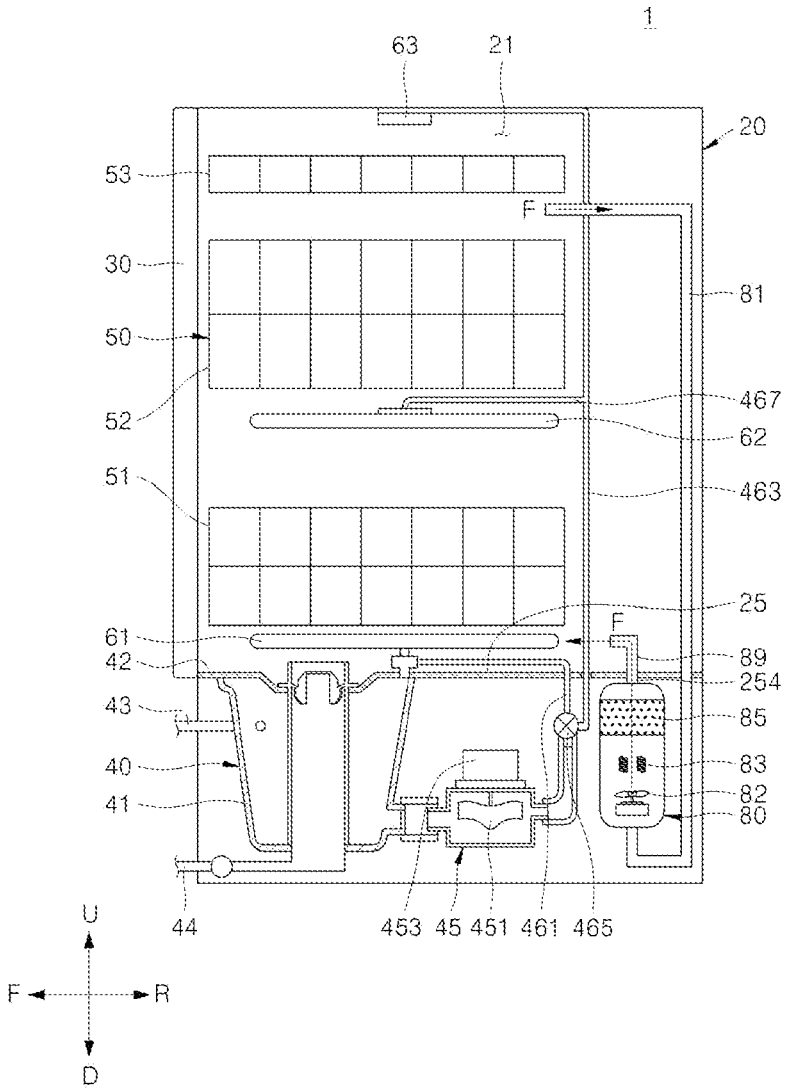
FIG. 2 is a schematic cross-sectional view showing the dishwasher illustrated in FIG. 1.
Figure 3:
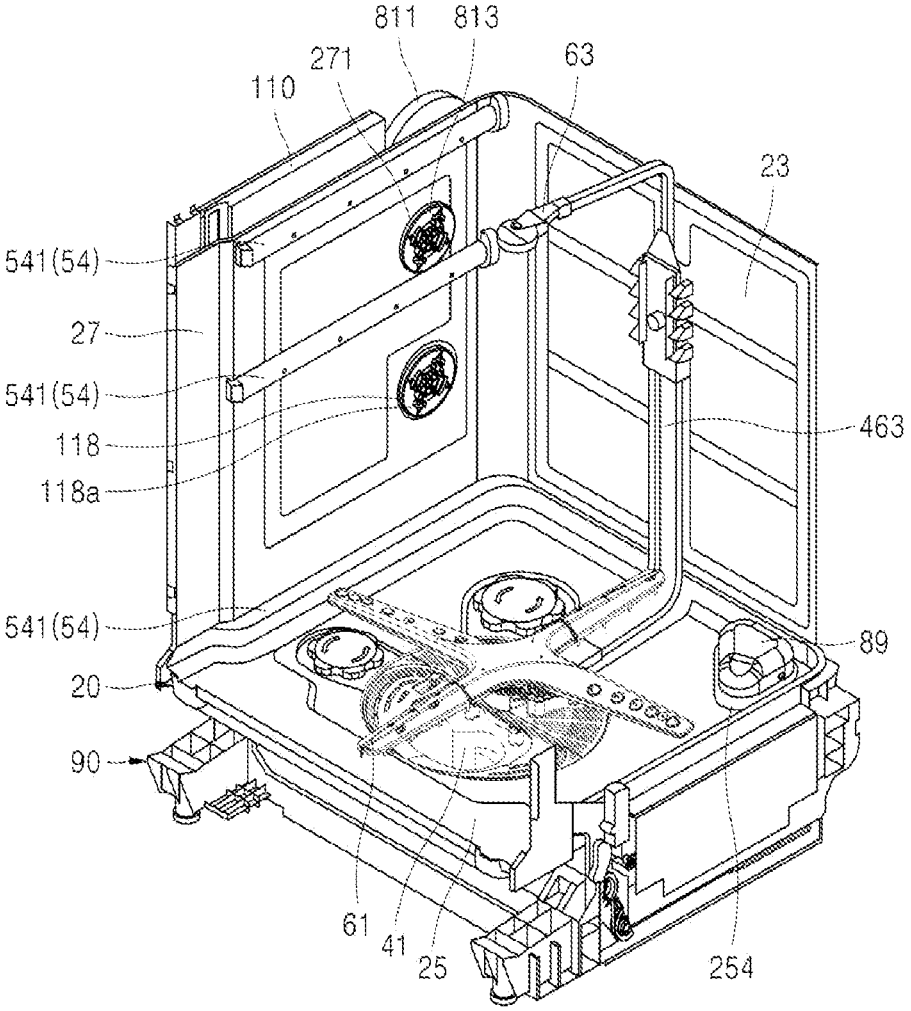
FIG. 3 is a front perspective view showing a state in which a door of the dishwasher illustrated in FIG. 1 is open.

FIG. 1 is a front perspective view showing a dishwasher of the present disclosure, FIG. 2 is a schematic cross-sectional view showing the inner structure of the dishwasher according to the present disclosure, and FIG. 3 is a front perspective view showing a state in which a door 30 of the dishwasher 1 illustrated in FIG. 1 is open.

As illustrated in FIGS. 1 to 3, the dishwasher 1 according to the present disclosure is provided with a case 10 forming the exterior of the dishwasher 1, a tub 20 being installed in the case 10, forming a wash space 21 in which a wash target is washed and having a front surface which is open, a door 30 opening and closing the open front surface of the tub 20, a driving part 40 being disposed in the lower portion of the tub 20 and supplying, collecting, circulating and discharging wash water for washing a wash target, a storage part 50 being detachably provided in the wash space 21 in the tub 20 and allowing a wash target to be mounted on, and a spray part 60 being installed near the storage part 50 and spraying wash water for washing a wash target.

At this time, a wash target mounted on the storage part 50 may be kitchenware such as a vessel, a dish, a spoon, chopsticks and the like, and other cooking tools, for example. Hereinafter, a wash target is referred to as kitchenware, unless state otherwise.

The tub 20 may be shaped into a box the front surface of which is open entirely, and corresponds to a so-called wash tub.

The wash space 21 may be formed in the tub 20, and the open front surface of the tub 20 may be opened and closed by the door 30.

The tub 20 may be shaped in such a way that a metal plate highly resistant against high temperature and moisture, e.g., a plate made of a stainless steel-based material, is pressed.

Additionally, a plurality of brackets may be disposed on the inner surface of the tub 20, to support and install functional components, such as the storage part 50, the spray part 60 and the like described hereinafter, in the tub 20.

Further, the driving part 40 may comprise a sump 41 storing wash water, a sump cover 42 distinguishing the sump 41 from the tub 20, a water supply part 43 supplying wash water to the sump 41 from the outside, a water discharge part 44 discharging wash water of the sump 41 to the outside, and a wash pump 45 and a supply flow path 46 for supplying wash water of the sump 41 to the spray part 60. The sump cover 42 may be disposed at the upper side of the sump 41, and distinguish between the tub 20 and the sump 41. Additionally, the sump cover 42 may be provided with a plurality of return holes for returning wash water, sprayed to the wash space 21 through the spray part 60, to the sump 41.

That is, wash water sprayed toward kitchenware from the spray part 60 falls to the lower portion of the wash space 21, and return to the sump 41 through the sump cover 42.

The wash pump 45 is provided in the lateral portion or the lower portion of the sump 41, and presses wash water and supplies the wash water to the spray part 60.

One end of the wash pump 45 may connect to the sump 41, and the other end may connect to the supply flow path 46. The wash pump 45 may be provided with an impeller 451 and a motor 453 and the like. As power is supplied to the motor 453, the impeller 451 may rotate, and wash water of the sump 41 may be pressed and then supplied to the spray part 60 through the supply flow path 46.

Though not illustrated, a wash water heater for heating wash water that is supplied at a time when a washing procedure or a heating and rinsing procedure proceeds may be provided at the other end side of the wash pump 45. The wash water heater is described hereinafter with reference to FIG. 14.

Additionally, the supply flow path 46 selectively supplies wash water supplied from the wash pump 45 to the spray part 60.

For example, the supply flow path 46 may comprise a first supply flow path 461 connecting to a lower spray arm 61, and a second supply flow path 463 connecting to an upper spray arm 62 and a top nozzle 63, and may be provided with a supply flow path diverter valve 465 opening and closing the supply flow paths 461, 463 selectively.

At this time, the supply flow path diverter valve 465 may be controlled in such a way that each of the supply flow paths 461, 463 is opened consecutively or simultaneously.

Further, the spray part 60 is provided to spray wash water to kitchenware and the like stored in the storage part 50.

Specifically, the spray part 60 may comprise a lower spray arm 61 being disposed in the lower portion of the tub 20 and spraying wash water to a lower rack 51, an upper spray arm 62 being disposed between the lower rack 51 and an upper rack 52 and spraying wash water to the lower rack 51 and the upper rack 52, and a top nozzle 63 being disposed in the upper portion of the tub 20 and spraying wash water to a top rack 53 or the upper rack 52.

In particular, the lower spray arm 61 and the upper spray arm 62 may be rotatably provided in the wash space 21 of the tub 20, and while rotating, may spray wash water to kitchenware in the storage part 50.

The lower spray arm 61 may be rotatably supported at the upper side of the sump cover 42 such that the lower spray arm 61 sprays wash water toward the lower rack 51 while rotating under the lower rack 51.

Further, the upper spray arm 62 may be rotatably supported by a spray arm holder 467 such that the upper spray arm 62 sprays wash water while rotating between the lower rack 51 and the upper rack 52.

Though not illustrated, a means for diverting a direction of wash water sprayed from the lower spray arm 61 to the upward direction U-direction may be further provided on a lower surface 25 of the tub 20, to enhance washing efficiency.

Regarding the spray part 60, since a configuration that has already been publicly known in the art may be applied to a detailed configuration of the spray part 60, detailed description of the configuration of the spray part 60 is omitted hereinafter.

Further, the storage part 50 for storing kitchenware may be provided in the wash space 21

The storage part 50 is provided in such a way that the storage part 50 is drawn from the inside of the tub 20 through the open front surface of the tub 20.

For example, FIG. 2 shows an embodiment provided with a storage part comprising a lower rack 51 which is dispose in the lower portion of the tub 20 and in which relatively large-sized kitchenware is stored, an upper rack 52 which is disposed at the upper side of the lower rack 51 and in which medium-sized kitchenware is stored, and a top rack 53 which is disposed in the upper portion of the tub 20 and in which small-sized kitchenware and the like is stored. The present disclosure is not limited to the above particulars, but an embodiment of a dishwasher provided with three storage parts 50 as described above is described.

The lower rack 51, the upper rack 52 and the top rack 53 may be respectively drawn to the outside through the open front surface of the tub 20.

To this end, a guide rail 53 may be provided on both lateral walls forming the inner circumferential surface of the tub 20, and for example, may comprise an upper rail, a lower rail and a top rail and the like.

Each of the lower rack 51, the upper rack 52 and the top rack 53 may have a wheel thereunder. The user may draw the lower rack 51, the upper rack 52 and the top rack 53 to the outside through the front surface of the tub 20, to store kitchenware on the racks, or readily take out kitchenware from the racks after a wash.

The guide rail 54 may be provided as a fixed guide rail shaped into a simple rail for guiding the withdrawal and insertion of the spray part 60 or a stretchable guide rail which guides the withdrawal and insertion of the spray part 60 and the withdrawn distance of which increases as the spray part 60 is drawn.

Additionally, the door 30 is used to open and close the open front surface of the tub 20 described above.

A hinge part for opening and closing the door 30 is provided in the lower portion of the front surface that is ordinarily open, and the door 30 is opened while rotating around the hinge part as a rotation axis.

Herein, a handle 31 for opening the door 30 and a control panel 32 for controlling the dishwasher 1 may be provided on the outer surface of the door 30.

As illustrated, the control panel 32 may be provided with a display 33 displaying information on a current operation state and the like of the dishwasher visually, and a button part 34 comprising a selection button to which a selection manipulation of the user is input and a power button to which a manipulation of the user for powering on/off the dishwasher is input, and the like.

Further, the inner surface of the door 30 may from a mounting surface that supports the lower rack 51 of the storage part 50 as the door 30 is opened fully, at the same time as the inner surface of the door 30 forms one surface of the tub 20 as the door 30 is closed.

To this end, the inner surface of the door 30 preferably forms a horizontal surface in a direction the same as a direction in which the guide rail 54 guiding the lower rack 51 extends, in the case where the door 30 is opened fully.

Additionally, a detergent supply device for supplying detergent into the tub 20 may be further provided on the inner surface of the door 30.

Further, the moisture-absorbing and drying device 80 may be provided under the tub 20, and absorb vapor included in air that is discharged from the tub 20 and then supply the air again to the tub 20, at a time when a drying procedure proceeds.

As illustrated, the moisture-absorbing and drying device 80 may comprise a suction duct 81 into which air discharged from the tub 20 is suctioned, an air blowing part 82 which generates a current of air, a heating part 83 which heats air suctioned from the tub 20, and an absorbent 85 which absorbs vapor included in air.

As described hereinafter, an air supply hole 254 may be provided on the lower surface 25 of the tub 20 and allow air from which vapor is removed through the moisture-absorbing and drying device 80 to be drawn into the tub 20.

As illustrated in FIG. 3, a grille cap 8113 that is coupled to the entrance of the suction duct 81 may be fixed onto one lateral surface, e.g., the right surface, of the tub 20.

A detailed configuration of the moisture-absorbing and drying device 80 is described hereinafter with reference to FIG. 1 to FIG. 3.

[Detailed Configuration of Moisture-Absorbing and Drying Device]

Hereinafter, a detailed configuration of the moisture-absorbing and drying device 80 of one embodiment is described with reference to FIG. 3 to FIG. 14.

As illustrated in FIG. 3 to FIG. 6, the moisture-absorbing and drying device 80 may be disposed such that the remaining portion of the suction duct 81 except for a main duct 811 and a discharge guide 89 of the suction duct 81 may be accommodated between a base 90 and the lower surface 25 of the tub 20 and may be supported by a bottom surface 91 of the base 90.

For example, the air blowing part 82, the heating part 83 and a housing 84 of the moisture-absorbing and drying device 80 may be disposed near a rear surface 93 of the base 90, and arranged in parallel with the rear surface 93 of the base 90.

The moisture-absorbing and drying device 80 may be disposed considering the characteristics of the heating part 83 of the moisture-absorbing and drying device 80, which generates high-temperature heat of about 200° C. or greater in an absorbent drying mode. That is, the moisture-absorbing and drying device 80 may be disposed at a position where the moisture-absorbing and drying device 80 avoids electronic components relatively greatly affected by high-temperature heat.

Since the air blowing part 82, the heating part 83 and the housing 84 of the moisture-absorbing and drying device 80 are disposed near the rear surface 93 of the base 90, and arranged in a row in parallel with the rear surface 93 of the base 90, as described above, a weight balance acting to prevent an inclination of the dishwasher 1, caused by a load applied to the door 30, may be ensured, in the state where the door 30 is opened fully.

Figure 4:
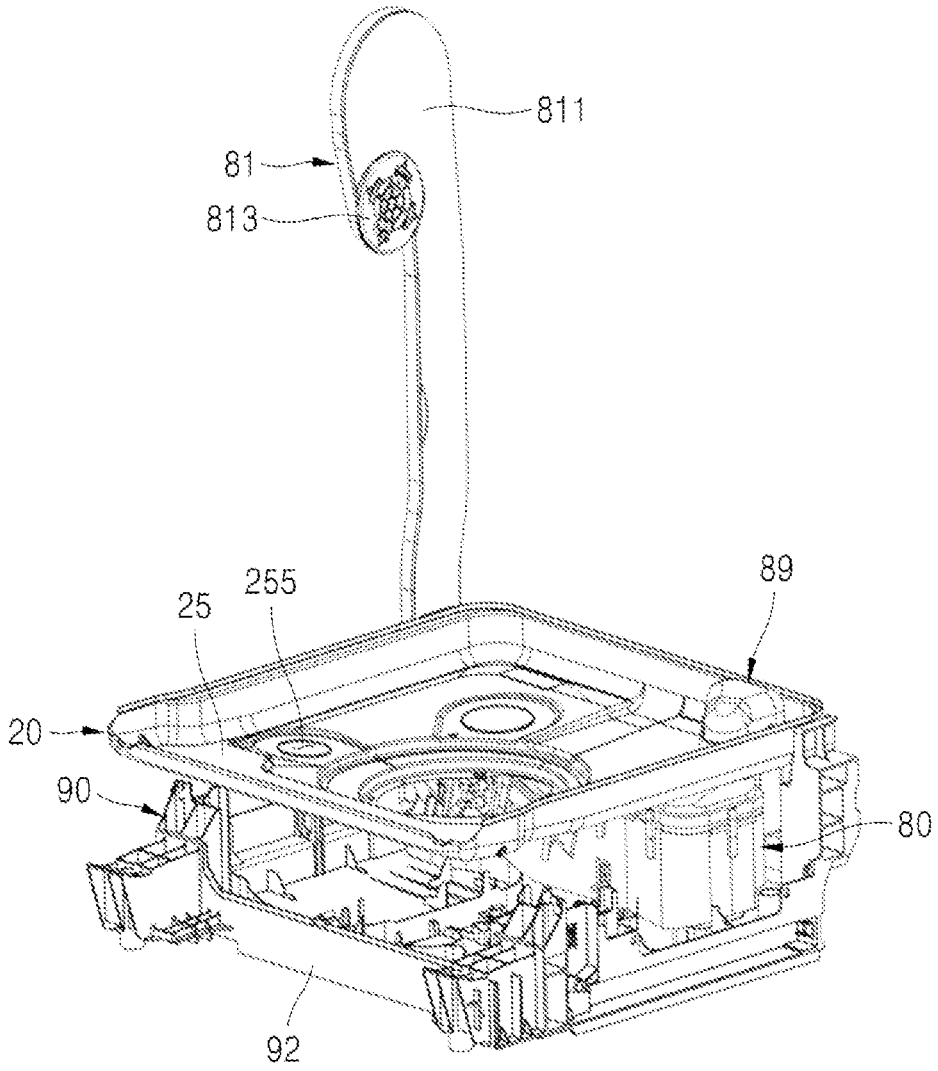
FIG. 4 is a front perspective view showing a state in which a moisture-absorbing and drying device of the dishwasher of one embodiment is accommodated in a base.
Figure 5:
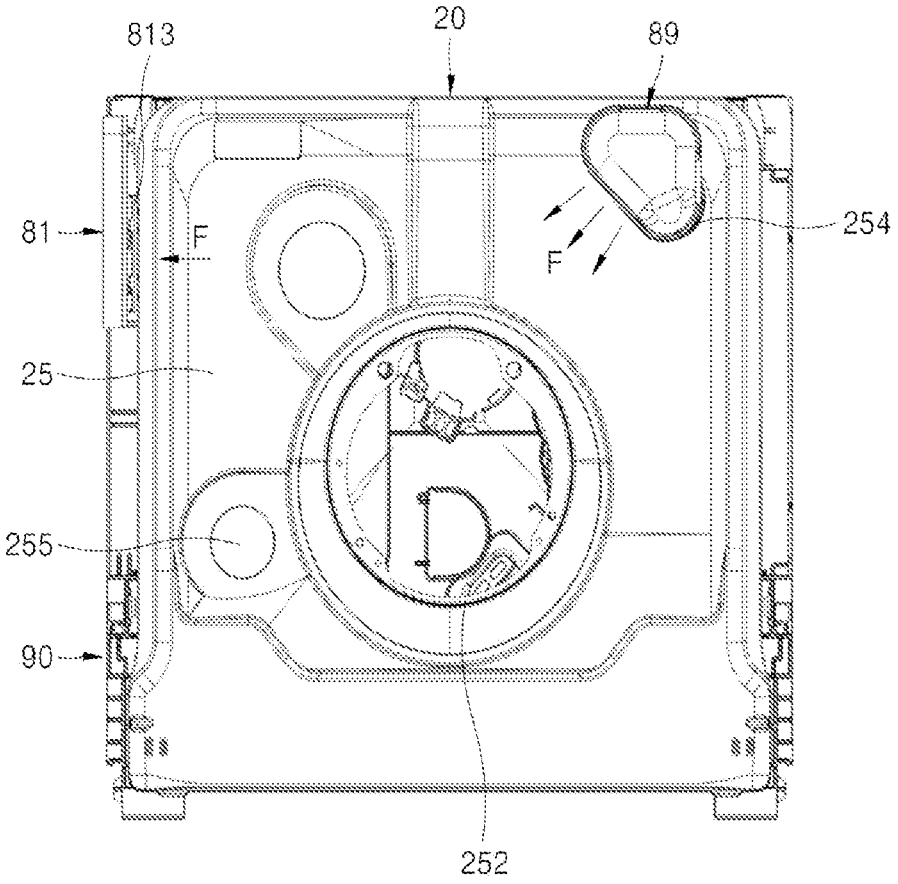
FIG. 5 is a plan view of FIG. 4.
Figure 6:
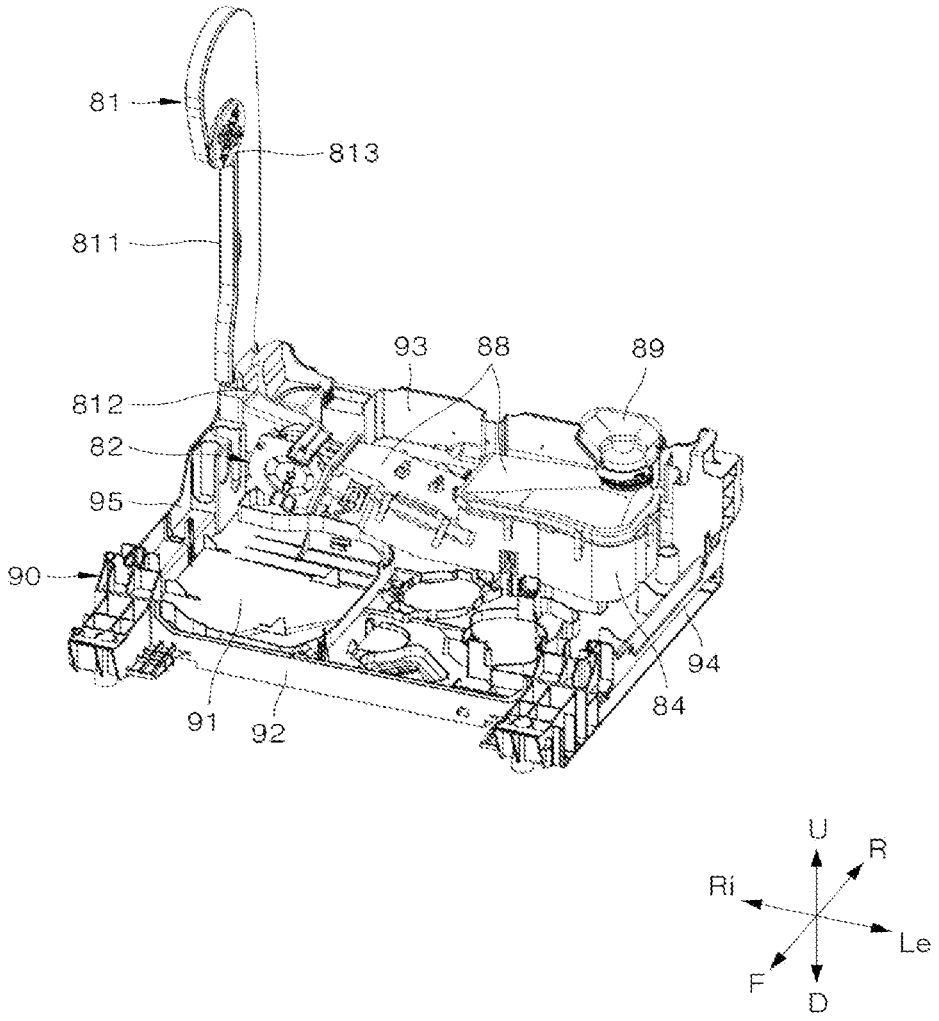
FIG. 6 is front perspective view showing a state in which a tub is removed from FIG. 4.

Additionally, the disposition position, as illustrated in FIG. 3 to FIG. 5, may be selected based on the position of the air supply hole 254 formed on the lower surface 25 of the tub 20. To be distinguished from a water softener communication hole 255 disposed near the front surface of the tub 20, the air supply hole 254 through which dry air is discharged may be formed at a corner near the rear surface and the left surface of the lower surface 25 of the tub 20, considering user safety.

Air supplied through the air supply hole 254 may be evenly distributed into the wash space 21 of the tub 20 through a discharge guide 89 that is disposed in the state of being exposed to the wash space 21.

For air, the moisture of which is absorbed effectively, to be supplied to the air supply hole 254 formed at the above position, the housing 84 of the moisture-absorbing and drying device 80 accommodating the absorbent 85 may be disposed near the lower portion of the air supply hole 254.

However, the position at which the moisture-absorbing and drying device 80 is disposed is given as an example, and the moisture-absorbing and drying device 80 may also be disposed near a left surface 94, a right surface 95 or a front surface 92 of the base 90 rather than the rear surface 93 of the base 90. In the present disclosure, the position of the moisture-absorbing and drying device 80 is not limited to the above-described position, but hereinafter, a moisture-absorbing and drying device 80 disposed approximately in parallel with the rear surface 93 of the base 90, near the rear surface 93 of the base 90, is described as an example.

Additionally, in the case where the air blowing part 82, the heating part 83 and the housing 84 of the moisture-absorbing and drying device 80 are disposed near the rear surface 93 of the base 90 in parallel with the rear surface 93, and the air supply hole 254 is formed at the corner near the rear surface and the left surface of the lower surface 25 of the tub 20 as illustrated in FIG. 3 to FIG. 6, an air suction hole 271 through which humid air is discharged from the tub 20 may be formed near an upper surface 24 of the tub 20 while being formed at an edge where the right surface and the rear surface of the right surface of the tub 20 meet.

The position of the air suction hole 271 may be selected as a position where the air suction hole 271 is farthest from the air supply hole 254 formed on the lower surface 25 of the tub 20.

Since the air suction hole 271 is disposed at a position where the air suction hole 271 is farthest from the air supply hole 254 and the discharge guide 89 as described above, air having passed through the air supply hole 254 and the discharge guide 89 is much less likely to be drawn again into the air suction hole directly without passing through a wash target.

Additionally, the air suction hole 271 may be disposed at a position higher than the position of an upper rail 542 constituting the guide rail 54 with respect to the up-down direction, e.g., disposed between a top rail 543 and the upper rail 542.

Thus, the air suction hole 271 maybe formed at a position higher than the position of the upper rack 52 which is held at the upper rail 542 and the movement of which is guided by the upper rail 542, with respect to the up-down direction, the movement of an air current F in the wash space 21 may be guided such that the air current is drawn into the air suction hole 271 after the air current passes through the lower rack 51 and the upper rack 52 evenly.

Further, as illustrated in FIG. 3, the air suction hole 271, together with a main duct 811 described hereinafter, may be formed at a rear of a water jacket 110 in which wash water to be supplied to the sump 41 storing wash water is stored.

At this time, as illustrated, a tub hole 118 allowing the inner space of the water jacket 110 to communicate with the wash space 21 of the tub 20 may be formed at the water jacket 110, and a water jacket communication hole 272 may be provided on a right surface 27 of the tub 20, to correspond to the tub hole 118.

The air suction hole 271 may be formed at a position where the air suction hole 271 avoids the water jacket 110 and formed further upwards than the water jacket communication hole 272.

As illustrated, a grille cap 118*a* having a similar shape to a grille cap 813 of the air suction hole 271 described above may be coupled to the tub hole 118 to minimize an inflow of wash water and prevent an inflow of a foreign substance.

Additionally, the grille cap 813 may be coupled to the air suction hole 271, and a flow of wash water scattered in the tub 20 and a flow of a foreign substance into the suction duct 81 may be minimized through the grille cap 813.

As described hereinafter, the grille cap 813 may be coupled to an entrance 811*a* of the main duct 811 constituting the suction duct 81 by passing through the air suction hole 271.

FIG. 7 to FIG. 14 show a detailed configuration of the moisture-absorbing and drying device 80.

The moisture-absorbing and drying device 80, as illustrated, may comprise an air blowing part 82 generating a current F of air suctioned from the tub 20 and to be supplied into the tub 20, a heating part 83 provided with a heater 831 heating air to be supplied to the absorbent 85, a plurality of absorbents 85 disposed in the lower streams of the air blowing part 82 and the heat part 83 with respect to a direction in which air flows, and configured to absorb moisture included in air, a housing 84 having a heater accommodation space S1 accommodating the hating part 83 and having an absorbent accommodation space S3 accommodating an absorbent 85, and a suction duct 81 connecting the air suction hole of the tub 20 and the air blowing part 82.

The air blowing part 82 is disposed in the upper stream of the heating part 83 and the absorbent 85, and disposed in the lower stream of the suction duct 81, with respect to a direction in which an air current F flows, and generates a current F of air to suction air from the tub 20 and allow the suctioned air to pass through the absorbent 85.

An air blowing fan, and an air blowing motor generating a rotation diving force of the air blowing fan may be modularized together and form an assembly in such a way that the air blowing fan and the air blowing motor are accommodated in a fan housing 821.

The fan housing 821 may be fixed to a main housing 841 described hereinafter, through a connecting bracket 822.

Figure 9:
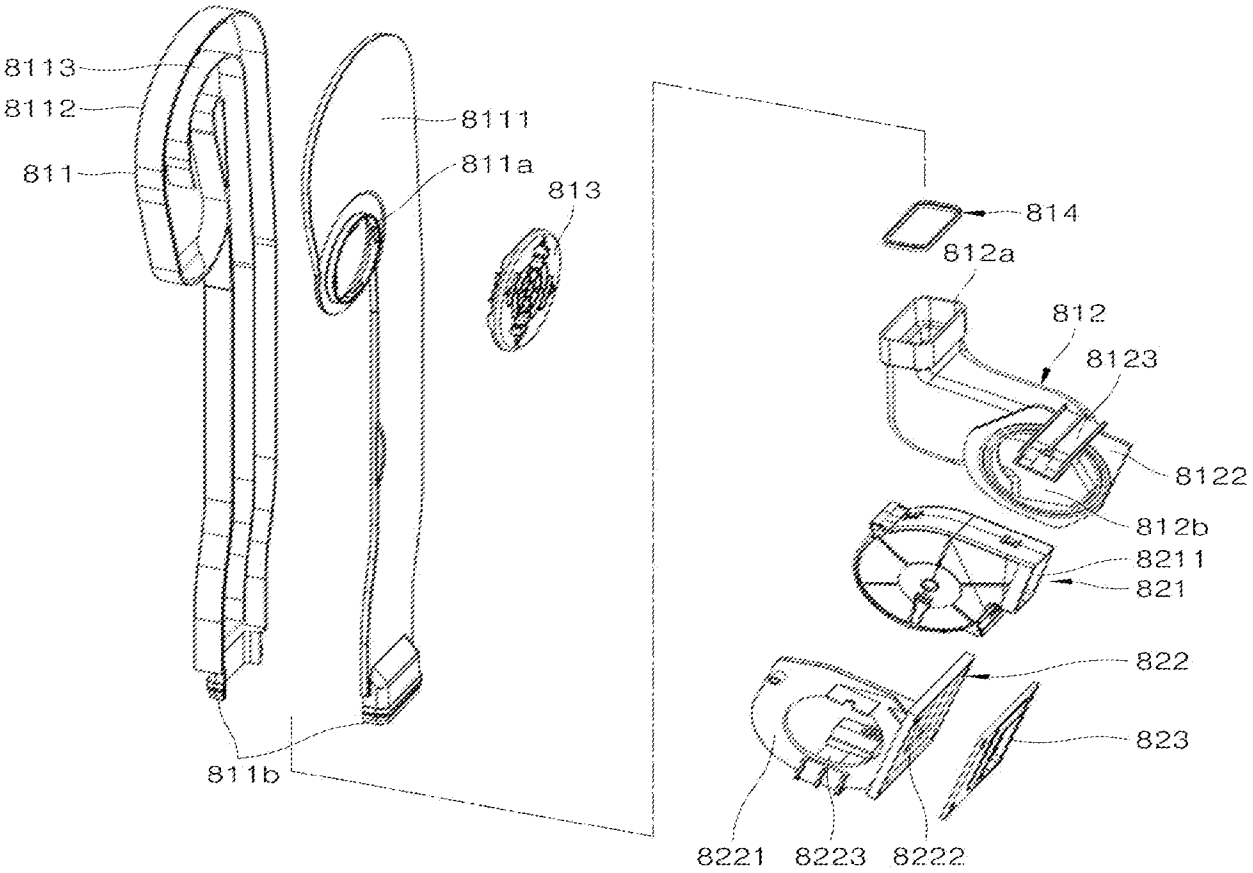
FIG. 9 is an exploded perspective view showing a suction duct and air blowing part of the moisture-absorbing and drying device illustrated in FIG. 7.

The connecting bracket 822, as illustrated in FIG. 9, may comprise a fan connection part 8221 which is shaped into a circular plate and coupled to one lateral surface of the fan housing 821, a housing connection part 8222 which is shaped into a rectangular plate and coupled to an inlet IN1 of the main housing 841, and a bridge part 8223 one end of which is fixed to the fan connection part 8221 and the other end of which extends to the other lateral surface of the fan housing 821 in the form of a rod.

The fan connection part 8221 may be provided in the form of a circular plate to correspond to the shape of one lateral surface of the fan housing 821, and in the state of surface-contacting one lateral surface of the fan housing 821, may be fastened to the fan housing 821 with a fastening means such as a screw bolt and the like.

The housing connection part 8222 may be arranged in a direction approximately perpendicular to a direction where the fan connection part 8221 is disposed, and connect integrally to an edge of the outer side of the fan connection part 8221. Accordingly, the housing connection part 8222 and the fan connection part 8221 may be arranged to have an L shape entirely.

The housing connection part 8222 may be shaped into a rectangular plate, considering the shape of the front end portion of the main housing 841, having an inlet IN1, i.e., the shape of the front end portion of a heater accommodation part 8411 of the main housing 841 as described hereinafter. The housing connection part 8222 may be fastened to the front end portion of the heater accommodation part 8411 of the main housing 841 with a fastening means such as a screw bolt and the like.

Additionally, the housing connection part 8222 may have a rectangular hole that is formed in a penetrating manner, to correspond to the shape of a discharge opening 8211 of the fan housing 821 and the shape of the inlet IN1 of the heater accommodation part 8411 of the main housing 841.

The discharge opening 8211 of the fan housing 821 may extend into the inlet IN1 of the main housing 841 by passing through the rectangular hole formed at the housing connection part 8222.

The bridge part 8223 may be disposed in such a way that one end of the bridge part 8223 integrally connects to the fan connection part 8221 while the other end extends to the other later surface of the fan housing 821 along the rotation axis of the air blowing fan. A fastening hole through which a fastening means such as a screw bole and the like passes may be formed at the other end of the bridge part 8223. Accordingly, a solid fastening structure in which the connecting bracket 822 is fastened by the bridge part 8223 up to the other lateral surface of the fan housing 821 may be achieved.

Additionally, a sub duct 812 constituting the suction duct 81 may be coupled and fastened to the other lateral surface of the fan housing 812 having a suction opening.

Further, as illustrated in FIG. 9, a gasket 823 shaped into a rectangular plate and made of an elastic material may be disposed between the housing connection part 8222 of the connecting bracket 822 and the front end portion of the heater accommodation part 8411 of the main housing 841.

The sort of the air blowing fan applied to the moisture-absorbing and drying device 80 is not limited, but for example, the air blowing fan may be a sirocco fan preferably considering constrains of the position and space where the air blowing fan is installed.

In the case where a sirocco fan is applied to the illustrated embodiment, air guided through the sub duct 812 of the suction duct 81 from the other lateral surface, i.e., the rear surface, of the fan housing 821 may be drawn from the center of the sirocco fan in a direction parallel with the rotation axis of the sirocco fan, and may be accelerated radially toward the outside and then discharged through the discharge opening 8211.

The air accelerated and discharged may be drawn into the heater housing 832 described hereinafter by passing through the inlet IN1 of the heater accommodation part 8411 of the main housing 841 while forming an air current F.

The heating part 83 is disposed between the air blowing part 82 and the absorbent 85 that are described above, with respect to a direction in which an air current F flows, and heats a current F of air to dry and reproduce the absorbent 85 at a time when an absorbent drying mode proceeds.

In the case where the moisture-absorbing and drying device 80 generates a high-temperature air current F in the absorbent drying mode, power is supplied to the heater 831 to heat an air current F, and in the case where the moisture-absorbing and drying device 80 generates a low-temperature air current F in a moisture absorbing mode, power supplied to the heater 831 is cut off and the heater 831 stops operating.

At this time, in the case where a low-temperature air current F is generated in the moisture absorbing mode, the air blowing motor may keep operating.

The sort of the hater 831 applied to the moisture-absorbing and drying device 80 of one embodiment is not limited, but for example, the heater 831 may be a tube-shaped sheath heater having a relatively simply structure, ensuring excellent heat generation efficiency and helping to prevent electric leakage caused by wash water drawn from the tub 20.

To enhance heat exchange efficiency, a heater main body 8311 that is a sheath heater may be directly exposed to a current F of air in the inner air passage of the heater housing 832, and may have a three-dimensional shape having a plurality of bends, to ensure a heat transfer surface area as much as possible.

FIG. 1 to FIG. 13 show an embodiment of an extended U-shaped heater main body 8311 that is bent again at 180 degrees and formed in two rows, for example. The heater main body is not limited to the above-described one in the present disclosure, but hereinafter, a heater main body 8311 extended in two rows is described like the embodiment.

The heater main body 8311 may be disposed in such a way that the heater main body 8311 extends between the inlet IN1 formed in one end portion, i.e., the front end portion, of the heater accommodation part 8411 of the main housing 841 and an outlet OUT1 formed in the other end portion, i.e., the rear end portion of the heater accommodation part 8411.

At this time, the heater main body 8311 may be disposed in the heater accommodation part 8411 in the state where the lengthwise direction of the heater main body 8311 is arranged in parallel with the lengthwise directions of the heater accommodation space S1 and the heater housing 832.

Accordingly, the heat exchange performance and heat exchange efficiency of the heater main body 8311 in the above-described arrangement may improve further than in an arrangement where the lengthwise direction of the heater main body 8311 crosses the lengthwise direction of the heater accommodation space S1.

However, the heater main body 8311, as described hereinafter, may be disposed in the heater accommodation part 8411 of the main housing 841 in such a way that the heater main body 8311 is closer to the outlet OUT1 formed in the rear end portion of the heater accommodation part 8411 than to the inlet IN1 formed in the front end portion of the heater accommodation part 8411.

That is, a gap formed between the front end portion of the heater main body 8311 and the inlet IN1 of the heater accommodation part 8411 may be greater than a gap formed between the rear end portion of the heater main body 8311 and the outlet OUT1 of the heater accommodation part 8411.

Accordingly, the heater main body 8311 may be disposed at a position where the heater main body 8311 is farthest from the air blowing part 82, and a possibility of damage to the air blowing fan and the air blowing motor of the air bowing part 82, caused by radiant heat of the heater main body 8311, may be minimized.

One end portion and the other end portion of the heater main body 8311 may extend by penetrating the front surface of the heater housing 832 and the front surface part of the heater accommodation part 8411 of the main housing 841.

Additionally, a pair of terminals 8312 for receiving power may be formed in one end portion and the other end portion of the heater main body 8311.

As illustrated, the pair of terminals 8312 may be installed in and fixed to the heater accommodation part 8411 of the main housing 841 through a terminal fixation part 8313.

At this time, a fixation slot 8411*c*1 may be provided at the front surface part of the heater accommodation part 8411 such that the terminal fixation part 8313 is fitted and coupled to the fixation slot 8411*c*1 in a sliding manner.

A slit-shaped groove extending in a sliding direction, i.e., the up-down direction U-D direction may be formed on both lateral surfaces of the terminal fixation part 8313, and the edge of the fixation slot 8411*c*1 is inserted, and fitted and coupled to the slit-shaped groove, while the terminal fixation part 8313 slides down from above.

As described above, the front end side of the heater main body 8311 may be fixed and supported through the terminal fixation part 8313.

Figure 13:
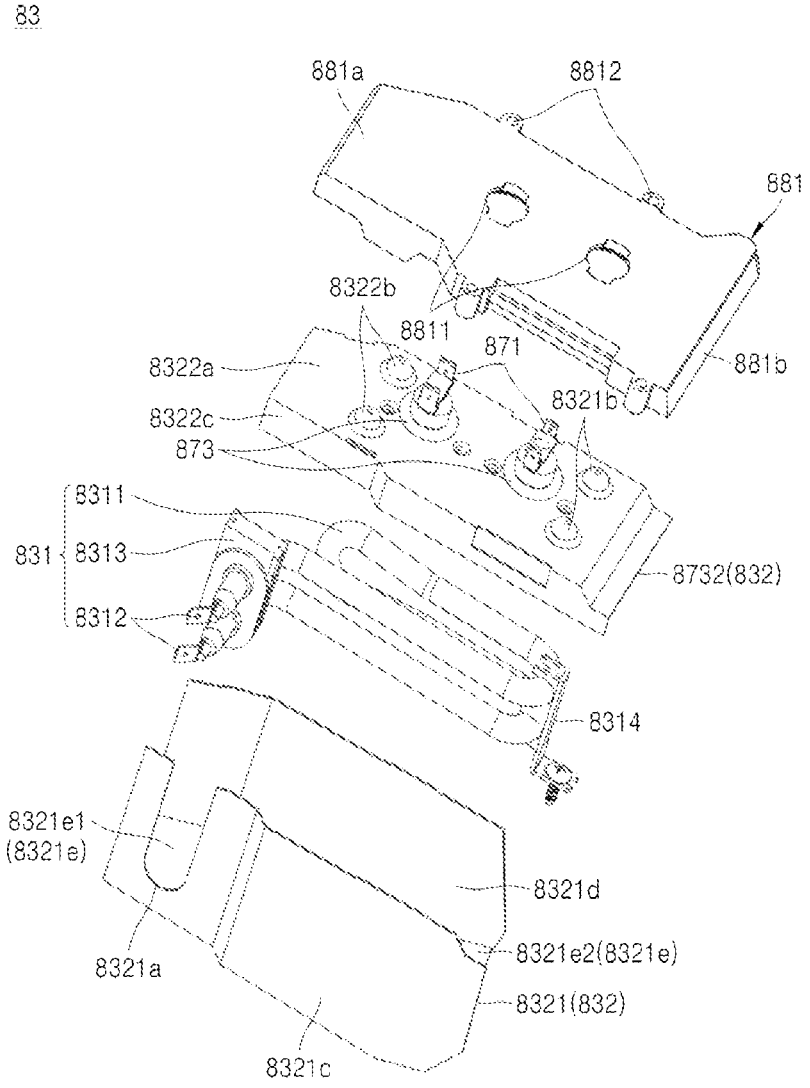
FIG. 13 and FIG. 14 are exploded perspective views showing a heating part and a first cover illustrated in FIG. 12.

The rear end side of the heater main body 8311, as illustrated in FIG. 13, may be fixed and supported by a single heater bracket 8314. That is, the rear end side of the heater main body 8311 may be supported on an air passage in the state where the heater main body 8311 separates from the heater housing 832 and from the heater accommodation part 8411 of the main housing 841 through the heater bracket 8314.

The heater bracket 8314 may be made of a metallic material considering the function of the heater main body 8311 generating high-temperature heat, and may be preferably manufactured in such a way that a metal plate highly resistant against high-temperature and moisture, e.g., a stainless steel-based plate is pressed.

For example, the heater bracket 8314 may be manufactured to have an L shape, as illustrated in FIG. 13.

As illustrated in the embodiment, two heater holders may be provided at a perpendicular extension part of the L shape, extending in the up-down direction U-D direction, and may be forcibly coupled to the outer surface of the heater main body 8311, to correspond to two rows of the heater main body 8311, such that the heater main body 8311 extending in two rows is supported effectively.

A pair of heater holders may be provided, and spaced from each other and formed at the perpendicular extension part in the up-down direction, to correspond to the two-row structure of the heater main body 8311, spaced from each other along the up-down direction U-D direction. Each of the heater holders may have a C-shaped exterior, to correspond to a tube-shaped exterior of the heater main body 8311.

Each of the heater holders maybe forcibly coupled to the outer surface of the heater main body 8311 in such a way that the heater holder is plastic-deformed at a time when the heater holder is coupled to the heater main body 8311, and may be forcibly coupled to the heater main body 8311 and modularized in advance, before the heater holder is fixed to a bottom surface part 8412*a* of an absorbent accommodation part 8412 constituting the main housing 841.

A horizontal extension part of the L shape, extending approximately along the left-right direction Le-Ri, may be integrally formed at the lower end of the perpendicular extension part.

The horizontal extension part directly contacts the bottom surface part 8412*a* of the absorbent accommodation part 8412 of the main housing 841, and supports the heater main body 8311 and the perpendicular extension part. The horizontal extension part may be fixed to the bottom surface part 8412*a* of the absorbent accommodation part 8412 through a fastening means such as a screw bolt and the like.

Figure 16:
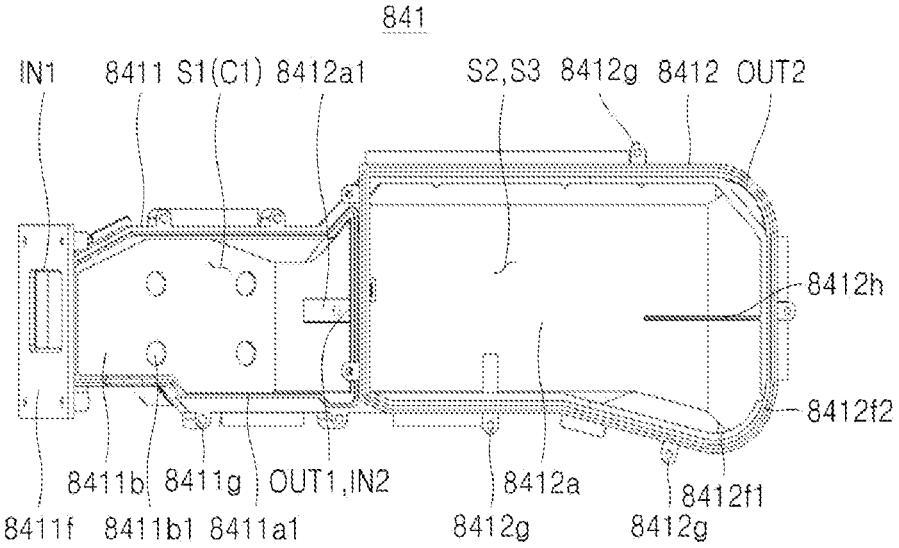

As illustrated in FIG. 16, a coupling groove 8412*a*1 for guiding a fastening position of the horizontal extension part may be formed at the bottom surface part 8412*a* of the absorbent accommodation part 8412 and may be concave with respect to the bottom surface part 8412*a* of the absorbent accommodation part 8412.

Additionally, the heater housing 832 may be shaped into a hollow hole having a vacant inner portion such that an air passage where the heater main body 8311 is disposed is formed in the heater housing 832. The air passage in the heater housing 832 may form a first flow channel C1 together with an air drawing space S2 formed under the absorbent accommodation part 8412.

As described above, the heater main body 8311 may be disposed in the heater housing 832 in such a way that the lengthwise direction of the heater main body 8311 is parallel with a direction in which an air current F flows. Accordingly, like the heater main body 8311, the heater housing 832 may be disposed in the heater accommodation space S1 of the heater accommodation part 8411 of the main housing 841 in such a way that the lengthwise direction of the heater housing 832 is parallel with the direction in which an air current F flows.

At this time, to correspond to the shape of the heater accommodation space S1, the heater housing 832 may extend linearly toward the air drawing space S2 along the lengthwise direction of the heater accommodation part 8411.

However, the length of the heater housing 832 may be greater than the length of the heater main body 8311 such that the heater housing 832 accommodates the heater main body 8311 entirely.

At this time, for an air current F to flow, the front end portion of the heater housing 832, corresponding to an upper stream side with respect to the direction an air current F flows, and the rear end portion of the heater housing 832, corresponding to a lower stream side with respect to the direction an air current F flows respectively may be open entirely.

For an air passage the front end portion and the rear end portion of which are open to be formed easily, the heater housing 832 may comprise a lower housing 8321 and an upper housing 8322 that are formed in a segmented manner with respect to the up-down direction U-D direction, for example.

The heater housing 832 is not limited to the above-described heater housing in the present disclosure, but hereinafter, the heater housing 832 comprised of a lower housing 8321 and an upper housing 8322 segmented and formed in the up-down direction as illustrated in FIG. 13 is described.

The lower housing 8321 constituting a segmented lower portion of the heater housing 832 forms a front surface, a rear surface and a lower surface of the heater housing 832, in the illustrated state.

A passage slot 8321*a* maybe formed in a U shape on a front surface 8321*c* of the lower housing 8321 such that the terminal 8312 of the heater main body 8311 described above may penetrate the passage slot 8321*a* forward.

A lower surface 8321*e* of the lower housing 8321, forming the lower end surface of the air passage in the lower housing 8321, may be formed approximately in parallel with a bottom surface part 8411*b* of the heater accommodation part 8411 of the main housing 841 described hereinafter. Since the bottom surface part 8411*b* of the heater accommodation part 8411 extends in parallel with the lengthwise direction of the heater accommodation part 8411, the lower surface 8321*e* of the lower housing 8321 may similarly extend in parallel with the lengthwise direction of the heater accommodation part 8411.

At this time, the edge of the front end of the lower surface 8321*e* of the lower housing 8321 may extend toward the lower end of the inlet IN1 of the heater accommodation part 8411, and the edge of the rear end of the lower surface 8321*e* of the lower housing 8321 may extend toward the outlet OUT1 of the heater accommodation part 8411.

Herein, the edge of the rear end of the he lower surface 8321*e* of the lower housing 8321 may extend up to a position past the front end portion of the bottom surface part 8412*a* of the absorbent accommodation part 8412.

As described hereinafter, the front end portion of the bottom surface part 8412*a* of the absorbent accommodation part 8412 may extend up to the inner portion of the heater accommodation part 8411.

Accordingly, the lower surface 8321*e* of the lower housing 8321 may have a bent shape corresponding to the shape of an edge formed by the rear end portion of the bottom surface part 8411*b* of the heater accommodation part 8411 and the front end portion of the bottom surface part 8412*a* of the absorbent accommodation part 8412 that meet each other.

Specifically, the lower surface 8321*e* of the lower housing 8321 may comprise a first surface 8321*e*1 that extends linearly while forming a first crossing angle a1 from the edge of the front end thereof to the edge of the lower end thereof together with the bottom surface part 8412*a* of the absorbent accommodation part 8412, and a second surface 8321*e*2 that bends from the first surface 8321*e*1 and extends in parallel with the bottom surface part 8412*a* of the absorbent accommodation part 8412.

For example, the first crossing angle a1 may be 20 to 25 degrees. Hereinafter, the crossing angle is defined as an angle that is less than angles formed by the extension lines of two straight lines or by the extension lines of two planar surfaces, which meet each other.

Accordingly, a direction of the extension of the lower end surface of the first flow channel C1 formed in the heater housing 832, at a position where the second surface 8321*e*2 of the lower surface 8321*e* of the lower housing 8321 is bend and formed from the first surface 8321*e*1, may be changed.

Additionally, the lower housing 8321 provides an air passage having a flow path surface area that is greater than the cross-sectional surface area of the inlet IN1 of the heater accommodation part 8411.

To this end, as illustrated FIG. 13, an expansion section, the cross section of which expands gradually along the front-rear direction along a direction where an air current F flows, may be included at the front end portion side of the lower housing 8321 and may expand along, for example.

As described above, since the air passage expands, the flow velocity of an air current F may decrease while the air current F passes through the inlet IN1 of the heater accommodation part 8411, and the efficiency of hear exchange between the heater main body 8311 and the air current F may improve.

Further, a plurality of first bead formation parts 8321*b* that is concave downward may be formed on the lower surface 8321*e* of the lower housing 8321.

Figure 14:
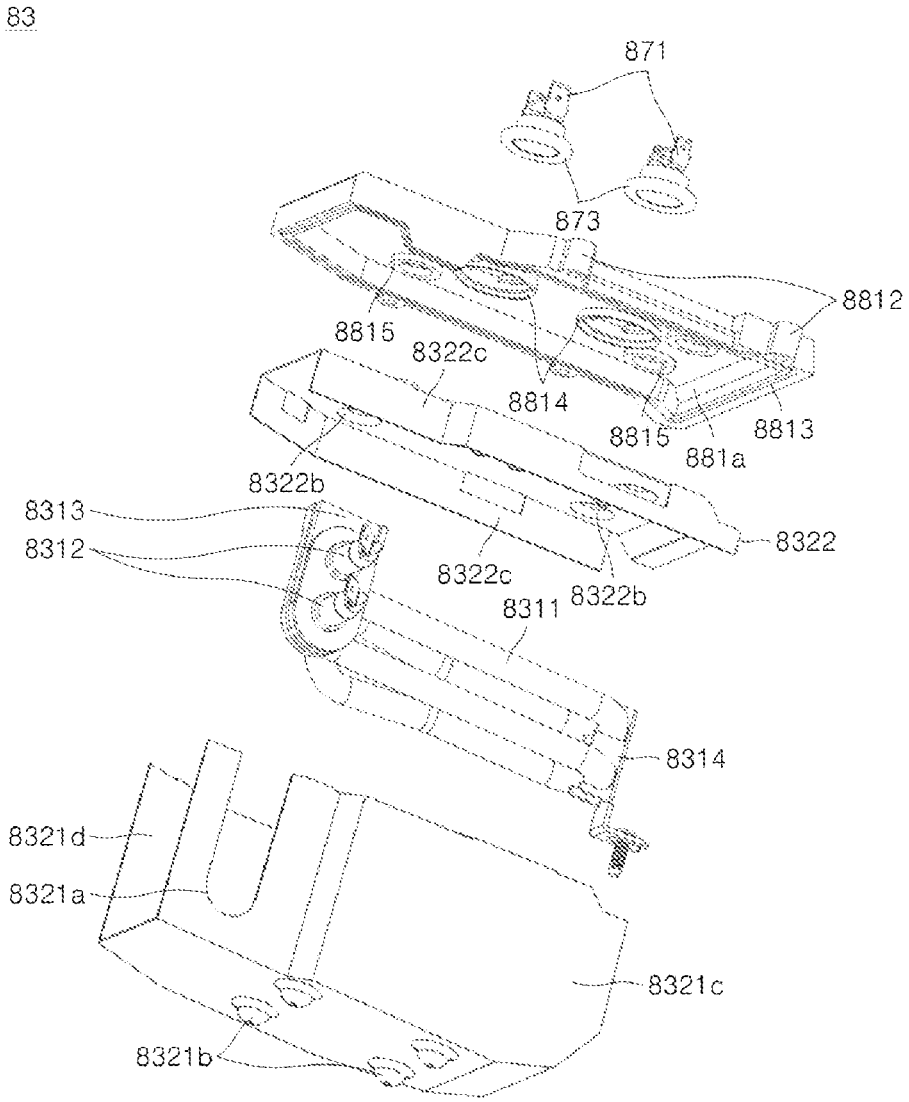

For example, FIG. 13 and FIG. 14 show that a total of four bead formation parts 8321*b* of the same shape and size 8321*b* is provided on the lower surface 8321*e* of the lower housing 8321. The bead forming part is not limited to the above-described one in the present disclosure, but the above-described bead formation part is described hereinafter.

As illustrated, each of the first bead formation parts 8321*b* may be shaped into an approximate hemisphere surface and protrude from the lower surface 8321*e* of the lower housing 8321, and may protrude from the lower surface 8321*e* of the lower housing 8321 to have the same height.

As described hereinafter, a bead groove 8411*b*1 having a cylindrical shape may be formed at a position on the bottom surface part 8411*b* of the heater accommodation part 8411, corresponding to the position of each of the first bead formation parts 8321*b*, and each of the first bead formation parts 8321*b* is at least partially inserted into the bead groove 8411*b*1.

Additionally, the upper housing 8322 is coupled to an open upper surface of the lower housing 8321, and closes the upper surface of the lower housing 8321 and defines the upper end surface of an air passage in the lower housing 8321.

To this end, an upper surface 8322*a* of the upper housing 8322 may have a size corresponding to the size of the open upper surface of the lower housing 8321. Additionally, the upper surface 8322*a* of the upper housing 8322 may be formed approximately in parallel with an upper surface part 8411*a* of the heater accommodation part 8411 of the main housing 841 described hereinafter.

The edge of the front end of the upper surface 8322*a* of the upper housing 8322 may extend toward the upper end of the inlet IN1 of the heater accommodation part 8411, and the edge of the rear end of the upper surface 8322*a* of the upper housing 8322 may extend toward the outlet OUT1 of the heater accommodation part 8411.

Herein, the edge of the rear end of the upper surface 8322*a* of the upper housing 8322 may extend up to the position of the upper end of the outlet OUT1 of the heater accommodation part 8411.

Further, the upper surface 8322*a* of the upper housing 8322, as described in relation to the lower housing 8321, may extend linearly while forming a first crossing angle a1 together with the bottom surface part 8412*a* of the absorbent accommodation part 8412, from the edge of the front end thereof to the edge of the lower end thereof.

Accordingly, the upper end surface of the first flow channel C1 formed in the heater housing 832 may extend linearly up to the outlet OUT1 of the heater accommodation part 8411.

Further, the edge of the front of the upper surface of the upper housing 8322 and the edge of the rear of the upper surface of the upper housing 8322 may have a coupling surface 8322*c* that is bent and formed downward.

At a time when the upper housing 8322 and the lower housing 8321 are coupled, the coupling surfaces 8322*c* may surface-contact the front surface 8321*c* and a rear surface 8321*d* of the lower housing 8321 respectively.

Accordingly, the strength of a coupling and a connection between the lower housing 8321 and the upper housing 8322 may improve.

Additionally, a temperature sensing part 87 may be provided at the upper side of the upper surface 8322*a* of the upper housing 8322, and a thermostat 871 for sensing whether the heater main body 8311 overheats may be disposed at the upper side of the upper surface 8322*a* of the upper housing 8322, as illustrated in FIG. 13.

For example, a pair of thermostats 871 may be provided, and the pair of thermostats 871 may be arranged along the lengthwise direction of the heater main body 8311, to effectively sense whether the heater main body 8311 overheats locally. The pair of thermostats 871 may be installed at a first cover 881 described hereinafter by passing through a pair of penetration holes 8811 formed at the first cover 881. A sealing ring 873 made of an elastic material may be provided between the penetration hole 8811 of the first cover 881 and the thermostat 871 to prevent leakage.

Figure 10:
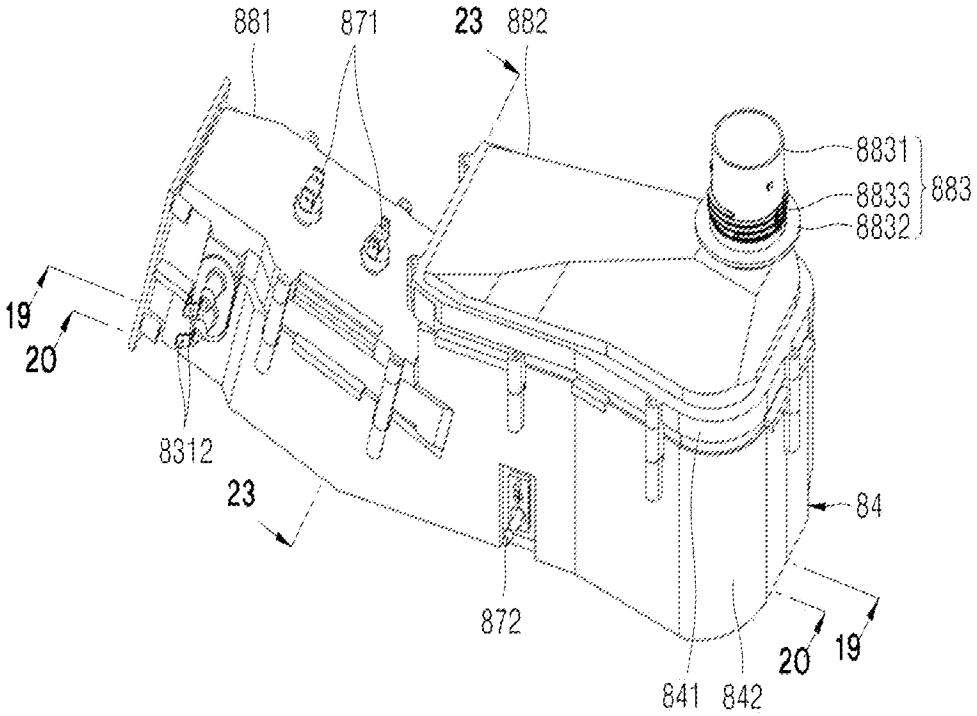
FIG. 10 and FIG. 11 are front perspective views showing a state in which a heating part, a housing and a cover of the moisture-absorbing and drying device illustrated in FIG. 7 are coupled.
Figure 11:
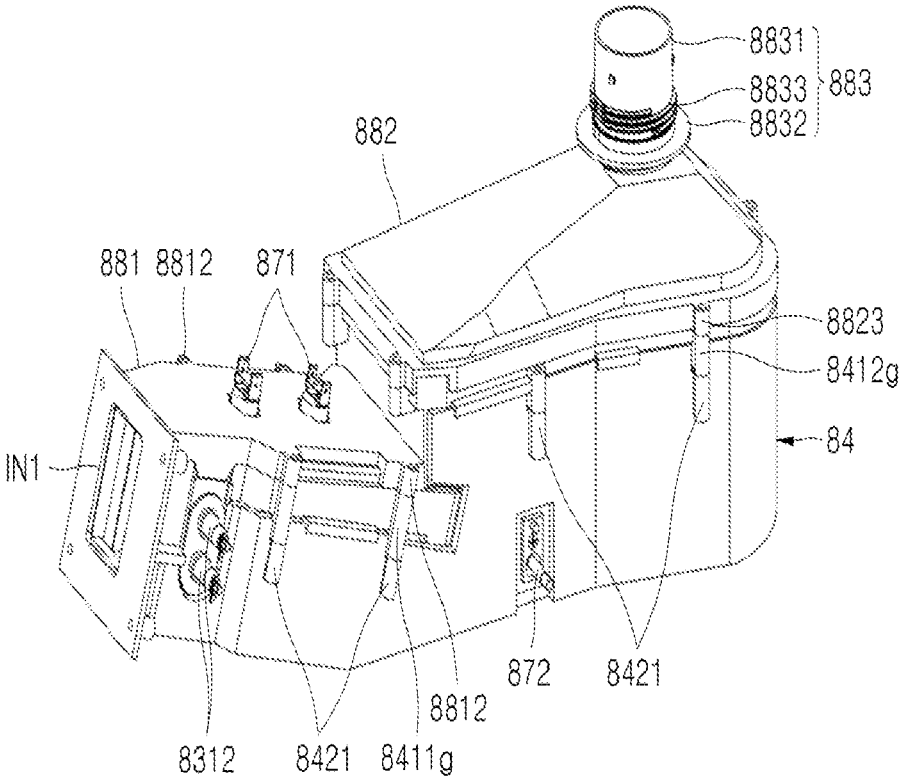

Additionally, the temperature sensing part 87 may be further provided with a thermistor 872 sensing the temperature of an air current F. Unlike the thermostat 871, the thermistor 872 senses the temperature an air current F having passed through the heater main body 8311. To this end, the thermistor 872, as illustrated in FIG. 10 and FIG. 11, may extend up to the inner portion of an air drawing space S2 described hereinafter by penetrating a front surface part 8412*b* of the absorbent accommodation part 8412 and the front surface part of the sub housing 842, which are a position in a lower stream of the heater main body 8311, to be least effected by radiant heat of the heater main body 8311, for example. As described above, the thermistor 872 may extend into the absorbent accommodation part 8412, to sense the temperature of an air current F having passed through the heater main body 8311, and may check whether an air current F of a proper temperature is supplied to the absorbent 85 while the moisture-absorbing and drying device 80 is operating.

An output signal of the temperature sensing part 87 may be delivered to a control unit not illustrated, and the control unit may receive an output signal of the temperature sensing part 87 to determine whether the heater main body 8311 overheats and determine the temperature of an air current F. In the case where overheating occurs, the control unit may cut off a supply of power to the heater main body 8311 to stop the heater main body 8311 from operating.

Additionally, a plurality of second bead forming parts 8322*b* that is convex upward may be formed on the upper surface 8322*a* of the upper housing 8322.

Like the first bead forming part 8321*b*, each of the second bead forming parts 8322*b* may be shaped into an approximate hemisphere surface and protrude from the upper surface 8322*a* of the upper housing 8322, and may protrude from the upper surface 8322*a* of the upper housing 8322 to have the same height.

As described hereinafter, a cylinder-shaped first rib 8815 may be provided at a cover main body 881*a* of the first cover 881, protrude toward the upper housing 8322, and be formed at a position corresponding to each of the second bead forming parts 8322*b*, and each of the second bead forming parts 8322*b* may be at least partially inserted into the first rib 8815.

Through the second bead forming part 8321*b* described above, a predetermined second separation space L2 may be formed between the first cover 881 disposed at the upper side of the upper housing 8322 and the upper housing 8322.

The second separation space L2 formed between the first cover 881 and the upper housing 8322 may serve as a heat insulation air layer for the upper housing 8322 like a lower separation space of a first separation space L1 of the lower housing 8321 described above.

Additionally, considering the fact that the heater main body 8311 generating high-temperature heat is disposed in the lower housing 8321 and the upper housing 8322, the lower housing 8321 and the upper housing 8322 may be formed in such a way that a metal plate highly resistant against high temperature and moisture, e.g., a plate made of a stainless steel-based material of approximately uniform thickness, is pressed.

The absorbent 85 absorbs moisture included in a current of air discharged from and suctioned into the tub 20 in the case where the moisture absorbing and drying device 80 operates in the moisture absorbing mode, and discharges absorbed moisture to an air current F in the case where the moisture absorbing and drying device operates in the absorbent drying mode.

That is, the absorbent 85 may be made of a reversibly dehydratable material to absorb moisture or discharge absorbed moisture depending on an operation temperature range.

A reversibly dehydratable material applicable may be a composition comprising any one of aluminum oxide, silicon oxide, silica gel, alumina silica, or zeolite, or a composition comprising a combination of two or more thereof.

In the present disclosure, an absorbent 85 made of an alumina silica-based material comprising aluminum oxide and silicon oxide may be applied to the moisture absorbing and drying device 80, for example. The absorbent 85 is not limited to that of the present disclosure, but hereinafter, an alumina silica-based absorbent 85 is described.

The absorbent 85 made of an alumina silica-based material as described above may be provided in the form of a particle having a predetermined grain diameter, to ensure a maximum surface area of contact with a current F of air. Additionally, a moisture absorbing action and a reproduction action of the alumina silica-based absorbent may occur in a lower temperature range than those of a pure aluminum oxide or pure silicon oxide-based absorbent. Moisture in a current F of air is absorbed by contacting the absorbent 85 while passing through between a plurality of absorbents 85 provided in the form of a particle, or absorbs moisture discharged from the absorbent 85.

As a result, the absorbent 85 acts as flow resistance against a current F of air. The grain diameter of the absorbent 85 may be selected to effectively form an air gap for minimizing the flow resistance and ensure optimal moisture absorption efficiency.

To this end, an absorbent 85 having a grain diameter of 2 mm to 6 mm may be selected and applied, for example.

Additionally, the absorbent 85 is disposed in the lower streams of the air blowing part 82 and the heating part 83 with respect to a direction in which an air current F flows.

Specifically, the absorbent 85 may be accommodated in the absorbent accommodation space S3 of the main housing 841, formed in the lower streams of the air blowing part 82 and the heating part 83.

The absorbent accommodation space S3 may be formed by a pair of absorbent holders 86 that is provided in the absorbent accommodation part 8412 of the main housing 841 and spaced from each other along the up-down direction.

Figure 12:
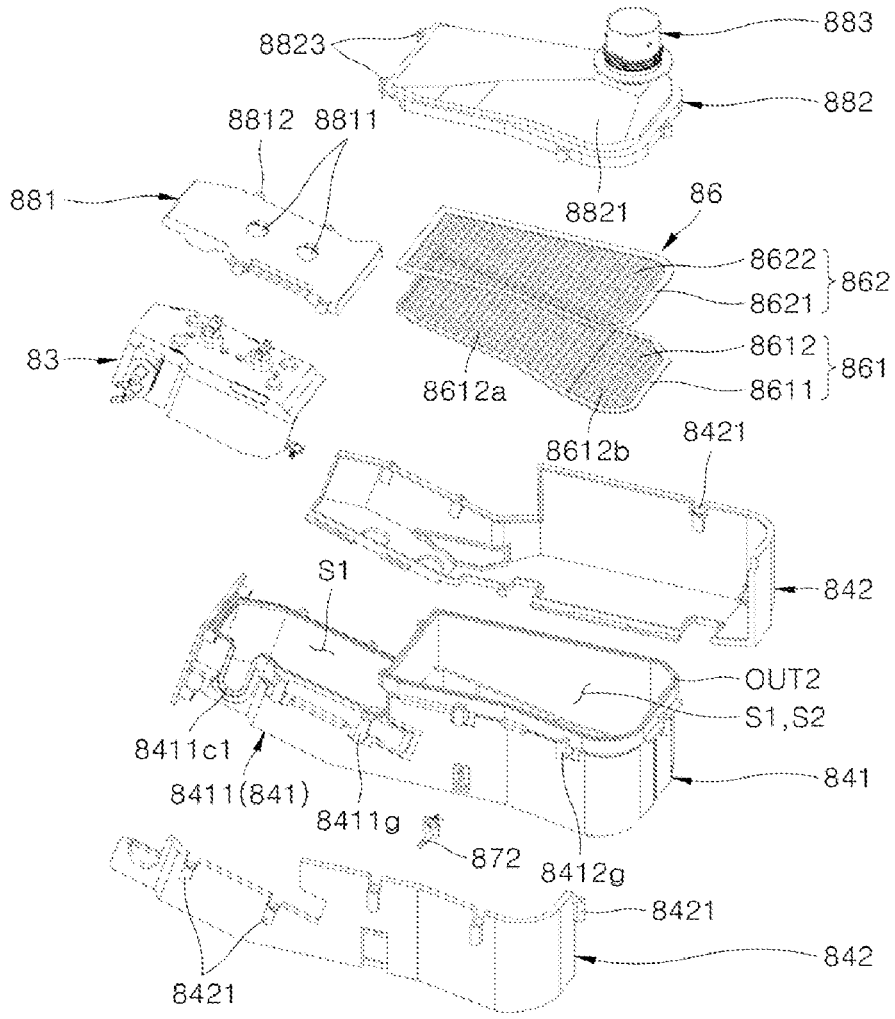
FIG. 12 is an exploded perspective view of FIG. 10 and FIG. 11.

As illustrated in FIG. 12, the pair of absorbent holders 86 may comprise a first absorbent holder 861 defining the lower end surface of the absorbent accommodation space S3 and dividing the inner portion of the absorbent accommodation part into the absorbent accommodation space S3 and the air drawing space S2, and a second absorbent holder 862 defining the upper end surface of the absorbent accommodation space S3, for example.

The first absorbent holder 861 and the second absorbent holder 862 may be respectively shaped into a plate to define the upper end surface of the absorbent accommodation space S3 and the lower end surface of the absorbent accommodation space S3.

Specifically, the first absorbent holder 861 may comprise an outer edge part 8611 for maintain entire strength, and a mesh part 8612 which is formed in the outer edge part 8611 and through which air passes.

Similarly, the second absorbent holder 862 may comprise an outer edge part 8621 for maintain entire strength, and a mesh part 8622 which is formed in the outer edge part 8621 and through which air passes.

Accordingly, a second flow channel C2 through a flow F of air passes may be formed between the mesh part 8612 of the first absorbent holder 861 and the mesh part 8622 of the second absorbent holder 862.

At this time, to prevent an escape of the absorbent 85, the grid size of the mesh part 8612 of the first absorbent holder 861 and the grid size of the mesh part 8622 of the second absorbent holder 862 may be less than the grain diameter of the absorbent 85.

Additionally, the mesh part 8622 of the second absorbent holder 862 may be disposed approximately in parallel with the bottom surface part 8412*a* of the absorbent accommodation part 8412, and the mesh part 8612 of the first absorbent holder 861 may be disposed to form a predetermined crossing angle with respect to the bottom surface part 8412*a* of the absorbent accommodation part 8412.

Specifically, the mesh part 8612 of the first absorbent holder 861 may be provided with a first holding surface 8612*a* forming a second crossing angle a2 (FIG. 19) with the bottom surface part 8412*a* of the absorbent accommodation part 8412, and a second holding surface 8612*b* forming a third crossing angle a3 (FIG. 17) with the bottom surface part 8412*a* of the absorbent accommodation part 8412.

That is, the mesh part 8612 of the first absorbent holder 861 may have a two-step inclination surface comprising the first holding surface 8612*a* and the second holding surface 8612*b*.

In the shape of the mesh part 8612 of the first absorbent holder 861, the height of the mesh part 8612 of the first absorbent holder 861 from the bottom surface part 8412*a* of the absorbent accommodation part 8412 decreases gradually, in a direction where the mesh part 8612 of the first absorbent holder 861 becomes far away from the heater accommodation part 8411.

In the above-described shapes and arrangements of the first absorbent holder 861 and the second absorbent holder 862, the up-down height H1 of the second flow channel C2 formed in the absorbent accommodation space S3 increases gradually in a direction where the second flow channel C2 becomes far away from the heater accommodation part 8411. Additionally, the up-down height H2 of the air drawing space S2 formed under the first absorbent holder 861 may decreases gradually in a direction where the air drawing space S2 becomes far away from the heater accommodation part 8411.

Further, the housing 84 of the moisture-absorbing and drying device 80 accommodates the heating part 83 and the absorbent 85 that are described above, and forms a first flow channel C1 of an air current F passing through the heater main body 8311 and a second flow channel C2 of an air current F passing through the absorbent 85.

The above-described heater housing 832 and absorbent holder 86 may function as a portion of the housing 84 in terms of the functions of accommodating the heater 831 and accommodating the absorbent 85 respectively.

Accordingly, the housing 84 of the moisture-absorbing and drying device 80 may be considered to be comprised of at least four parts that distinguish from one another. The at least four parts may comprise a main housing 841, a sub housing 842, the above-describe heater housing 832, and the above-described absorbent holder 86.

A separation space may be formed respectively between the main housing 841 and the sub housing 842 and between the main housing 841 and the heater housing 832.

From the perspective of the heater 831, the housing of the heater 831 may have a double structure in which the housing of the heater 831 surrounds the heater housing 832 which surrounds the heater 831, and the heater accommodation part 8411 of the main housing 842, which is disposed outside the heater housing 832, in terms of the function of accommodating the heater 831.

Additionally, in the case where the sub housing 842 is coupled to the outer surface of the heater accommodation part 8411 as described hereinafter, the housing 84 of the heater 831 may have a triple structure.

A first separation space L1 is formed between the heater housing 832 and the heater accommodation part 8411 of the main housing 841, and a third separation space is formed between the heater accommodation part 8411 and the sub housing 842, promoting heat insulation for the heater 831. The first separation space L1 may be formed based on a structure of partial contact between the heater housing 832 and the main housing 841, and the third separation space L3 may be formed based on a structure of partial contact between the main housing 841 and the sub housing 842.

Additionally, from the perspective of the absorbent 85, the housing of the absorbent 85 may have a structure in which the housing of the absorbent 85 comprises an absorbent holder 86 preventing an escape of the absorbent 85 and limiting the movement of the absorbent 85, an absorbent accommodation part 8412 of the main housing 841 accommodating the absorbent holder 86 and the absorbent 85, and a sub housing 842 being coupled to the outer surface of the absorbent accommodation part 8412, in terms of the function of accommodating the absorbent 85.

That is, the housing of the absorbent 85 may be comprised of three parts comprising the double structure formed by the absorbent accommodation part 8412 of the main housing 841 and the sub housing 842, and the absorbent holder 86.

As described above, the third separation space L3 acting as a second heat insulation air layer is formed between the main housing 841 and the sub housing 842, ensuring improvement in heat insulation. The third separation space L3 may be formed based on a structure of partial contact between the main housing 841 and the sub housing 842.

Hereinafter, detailed configurations of the main housing 841 and the sub housing 842 are described with reference to FIG. 15 and FIG. 16. The main housing 841 may comprise a heater accommodation part 8411 having a heater accommodation space S1 therein, and an absorbent accommodation part 8412 having an absorbent accommodation space S3 therein.

As illustrated, in the state of being disposed at the base 90, an upper surface part 8411*a* of the heater accommodation part 8411 may be open entirely, and shaped into a box having an entirely cuboid shape and a hollow hole.

In the illustrated embodiment, the heater accommodation part 8411 is formed in such a way that the heater accommodation part 8411 integrally connects to the absorbent accommodation part 8412. However, the configuration of the heater accommodation part 8411 is not limited in the present disclosure, and the heater accommodation part 8411 and the absorbent accommodation part 8412 of the main housing 841 may be separately manufactured and fastened. Hereinafter, the heater accommodation part 8411 formed in such a way that the heater accommodation part 8411 integrally connects to the absorbent accommodation part 8412 is described, for example.

The heater housing 832 and the heater main body 8311 may be inserted through the open upper surface 8411*a* of the heater accommodation part 8411.

Specifically, after a lower housing 8321 of the heater housing 832 is inserted into the heater accommodation space S1, the heater main body 8311 may be assembled to the lower housing 8321, and after the heater main body 8311 is assembled completely, an upper housing 8322 of the heater housing 832 may be assembled to the lower housing 8321.

At this time, a plurality of bead grooves 8411*b*1 may be formed at a position of the bottom surface part 8411*b* of the heater accommodation part 8411, which corresponds to the position of a plurality of first bead forming parts 8321*b* provided on the lower surface 8321*e* of the lower housing 8321, as described above.

Each of the first bead forming parts 8321*b* may be partially inserted into a corresponding bead groove 8411*b*1, such that a lower separation space constituting the first separation space L1 having a predetermined gap is formed between the bottom surface part 8411*b* of the heater accommodation part 8411 of the main housing 841 and the lower surface 8321*e* of the lower housing 8321. The lower separation space described above may act as a heat insulation air layer for the lower housing 8321.

The open upper surface of the heater accommodation part 8411 may be coupled with and closed by a first cover 881 described hereinafter after the heating part 83 is disposed and assembled completely. To this end, a coupling rib 8411*a*1 protruding upward may be integrally formed at the edge of the open upper surface part of the heater accommodation part 8411.

The coupling rib 8411*a*1 may have a thickness less than the thickness of the heater accommodation part 8411, and be continuously formed along the edge of the open upper surface part of the heater accommodation part 8411.

A linear groove 8813 into which the coupling rib 8411*a*1 is inserted at a time of a coupling of the first cover 881 may be continuously formed at the lower end of an outer perimeter surface 881*b* of the first cover 881 described hereinafter.

Through the coupling rib 8411*a*1 of the heater accommodation part 8411 and the linear groove 8813 of the first cover 881, the leakage of an air current F may be minimized in the state where the first cover 881 is fastened, and the coupling strength between the heater accommodation part 8411 and the first cover 881 may improve.

Additionally, a fastening boss 8411*g* may be integrally provided at a position of a front surface part 8411*c* and a rear surface part 8411*d* of the heater accommodation part 8411, which corresponds to the position of a fastening boss 8812 of the first cover 881.

A heater accommodation space S1 having a shape corresponding to the outer shape of the heater housing 832 may be formed in the heater accommodation part 8411 having a hollow hole.

Figure 15:
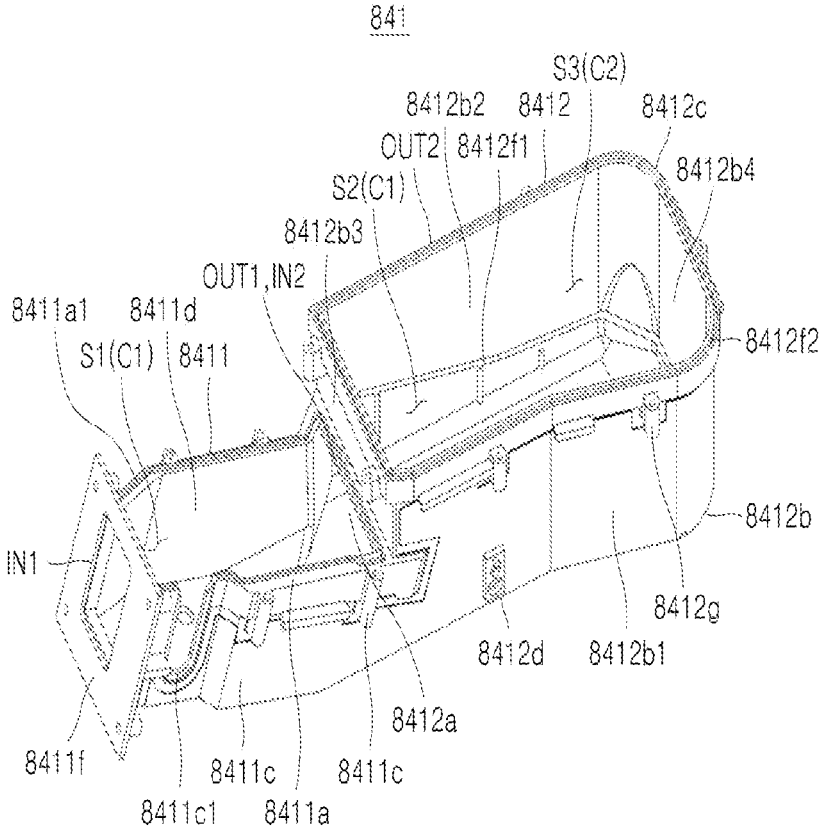
FIG. 15 and FIG. 16 are respectively a perspective view and a plan view showing a main housing illustrated in FIG. 12.

More specifically, as illustrated in FIG. 15 and FIG. 16, to accommodate the heater main body 8311 and the heater housing 832 entirely, the heater accommodation part 8411 may extend linearly along a direction approximately parallel with the lengthwise direction of the heater main body 8311 and a direction in which an air current F flows. Accordingly, the heater accommodation space S1 formed in the heater accommodation part 8411 may extend linearly along the lengthwise direction of the heater accommodation part 8411.

At this time, the lengths of the heater accommodation part 8411 and the heater accommodation space S1 may be greater than the length of the heater housing 832, and the widths of the heater accommodation part 8411 and the heater accommodation space S1 may be greater than the width of the heater housing 832.

Further, the surfaces of both end portions, i.e., the surface of the front end formed at a right surface part 8411*f* and the surface of the rear end formed at a left surface part, of the heater accommodation part 8411 along the lengthwise direction thereof are partially open.

An open portion of the surface of the front end of the heater accommodation part 8411 may form an inlet IN1 into which an air current F is drawn, and an open portion of the surface of the rear end may form an outlet OUT1 from which an air current F having passed through the heater main body 8311 is discharged.

As described above, the discharge opening 8211 of the fan housing 821 may be inserted into and coupled to the inlet IN1 formed at the right surface part 8411*f* of the heater accommodation part 8411. The right surface part 8411*f* of the heater accommodation part 8411 may be provided in the form of a flange surface that expands outward from the inlet IN1 such that the right surface part 8411*f* of the heater accommodation part 8411 acts as a coupling surface to which the heater bracket 8314 described above is coupled.

Additionally, the outlet OUT1 of the heater accommodation part 8411 may communicate with the inlet IN2 of the absorbent accommodation part 8412. As illustrated in the embodiment, in the case where the heater accommodation part 8411 and the absorbent accommodation part 8412 connect integrally, the outlet OUT1 of the heater accommodation part 8411 and the inlet IN2 of the absorbent accommodation part 8412 may be integrated, and the outlet OUT1 of the heater accommodation part 8411 may also serve as the inlet IN2 of the absorbent accommodation part 8412.

Further, the heater accommodation part 8411 may extend at a downward slant in such a way that the up-down height of the flow channel formed by the heater accommodation space S1 and the heater housing 832 decreases further toward the absorbent accommodation part 8412.

That is, the center of the inlet IN1 of the heater accommodation part 8411 may be formed at a position higher than the position of the center of the outlet OUT1, and the lengthwise directions or extension directions of the heater accommodation space S1 and the heater housing 832 may be formed at a downward slant with respect to the horizontal direction.

From the perspective of the bottom surface part 8412*a* of the absorbent accommodation part 8412, the heater accommodation part 8411 may be inclined such that a first crossing angle a1 may be formed between the lengthwise direction of the heater accommodation space S1 and the lengthwise direction of the bottom surface part 8412*a* of the absorbent accommodation part 8412. The flow channel in the heater accommodation space S1 is substantially formed in the heater housing 832, but each of the lower surface 8321*e* and the upper surface 8322*a* of the heater housing 832 are formed in parallel with the bottom surface part 8411*b* and the upper surface part 8411*a* of the heater accommodation part 8411, and accordingly, the heater accommodation part 8411 is described hereinafter.

As illustrated in the embodiment, in the case where the bottom surface part 8411*b* and the upper surface part 8411*a* of the heater accommodation part 8411 extend in a direction parallel with the lengthwise direction of the heater accommodation part 8411, a first crossing angle a1 is considered to be formed between the bottom surface part 8411*b* of the heater accommodation part 8411 and the bottom surface part 8412*a* of the absorbent accommodation part 8412.

As described above, the front end portion side of the heater housing 832 may comprise an expansion section that expands in such a way that the cross-sectional area of a flow path expands gradually in a direction in which an air current F flows, along the front-rear direction.

In response, the front end portion side of the rear surface 8321*d* of the heater housing 832 may comprise an inclination surface that has a predetermined inclination angle with respect to a direction in which an air current F flows such that the cross-sectional area of the flow path may expand with respect to the direction in which an air current F flows.

Additionally, a fixation slot 8411*c*1 may be provided at the front surface part 8411*c* of the heater accommodation part 8411 such that the terminal fixation part 8313 of the heater main body 8311, described above, is fitted and coupled to the fixation slot 8411*c*1 in a sliding manner.

Additionally, in the state of being disposed at the base 90, the absorbent accommodation part 8412 of the main housing 841 may be arranged in a row in such a way that the lengthwise direction of the absorbent accommodation part 8412 is parallel with the lengthwise direction of the heater accommodation part 8411.

The upper surface part 8412*c* of the absorbent accommodation part 8412 may be entirely open, and shaped into a box having a cuboid shape entirely and a hollow hole.

The open upper surface 8412*c* of the absorbent accommodation part 8412 may function as an outlet OUT2 through which air having passed through the absorbent 85 is discharged.

The open upper surface 8412*c* of the absorbent accommodation part 8412 may be coupled to and closed by a second cover 882 described hereinafter, after the absorbent holder 86 and the absorbent 85 are disposed completely in the absorbent accommodation part 8412.

To this end, a fastening boss 8412*g* may be integrally provided at a front surface part 8412*b*1, a rear surface part 8412*b*2, a right surface part 8412*b*3 and a left surface part 8412*b*4 of an outer perimeter surface part 8412*b* of the absorbent accommodation part 8412, which are positions corresponding to the position of a fastening boss 8823 of the second cover 882.

Specifically, as illustrated in FIG. 15 and FIG. 16, the absorbent accommodation part 8412 may have an outer shape of a cuboid in which the left-right width between the left surface part 8412*b*4 and the right surface part 8412*b*3 is greater than the front-rear width between the front surface part 8412*b*1 and the rear surface part 8412*b*2 and the up-down height between the upper surface part 8412*c* and the bottom surface part 8412*a*. Accordingly, as described in relation to the heater accommodation part 8411, the left-right direction of the absorbent accommodation part 8412 may be the lengthwise direction thereof.

However, the left-right width and the front-rear width of the absorbent accommodation part 8412 may be greater than the left-right width and the front-rear width of the heater accommodation part 8411. Accordingly, a greater air drawing space S2 and a greater absorbent accommodation space S3 formed in the absorbent accommodation part 8412 may be ensured.

Further, the right surface part 8412*b*3 of the outer perimeter surface part 8412*b* of the absorbent accommodation part 8412 may be partially open to form an inlet IN2 into which air having passed through the heater accommodation part 8411 is drawn. At this time, the lower end of the inlet IN2 may extend up to the bottom surface part 8412*a* that maintains a planar surface while forming the floor surface in the the absorbent accommodation part 8412, and the upper end of the inlet IN2 may be formed at a position lower than the position of the upper surface part 8412*c*.

Further, as described above, the inlet IN2 of the absorbent accommodation part 8412 may be integrated with the outlet OUT1 of the heater accommodation part 8411.

The first absorbent holder 861 may divide the absorbent accommodation space S3 as the inner space of the absorbent accommodation part 8412, in the up-down direction.

Among the spaces divided by the first absorbent holder 861 in the up-down direction, the lower space may be an air drawing space S2 into which air having passed through the heater accommodation part 8411 is drawn, and the upper space may be an absorbent accommodation space S3 in which the absorbent 85 is accommodated.

A thermistor installation part 8412*d* for fastening the above-described thermistor 872 may be integrally formed at the front surface part 8412*b*1 of the outer perimeter surface part 8412*b*, as a position corresponding to the position of the air drawing space S2.

Additionally, the heater accommodation space S1 of the heater accommodation part 8411, and the air drawing space S2 and the absorbent accommodation space S3 of the absorbent accommodation part 8412 constitutes a continuous flow channel in which a flow F of air is formed. Specifically, the air drawing space S2 forms a lower stream of the first flow channel C1, and the absorbent accommodation space S3 forms a second flow channel C2.

A first step part 8412*f*1 and a second step part 8412*f*2 for supporting the first absorbent holder 861 and the second absorbent holder 862 may be formed on the inner surface of the outer perimeter surface part 8412*b*.

As illustrated, the first step part 8412*f*1 may protrude from the inner surfaces of the front surface part 8412*b*1, the rear surface part 8412*b*2 and the left surface part 8412*b*4 of the outer perimeter surface part 8412*b*, between the bottom surface part 8412*a* and the upper surface part 8412*c* of the absorbent accommodation part 8412, to support the first absorbent holder 861 between the bottom surface part 8412*a* and the upper surface part 8412*c*, and may be formed to extend in a direction where the first step part 8412*f*1 becomes far away from the inlet IN1 of the heater accommodation part 8411.

At this time, the first step part 8412*f*1 may extend to have a two-step inclination angle corresponding to the second crossing angle a2 and the third crossing angle a3 of the first absorbent holder 861.

Additionally, the end portion of the right side of the first step part 8412*f*1 may be formed at a position near the upper end of the inlet IN1 of the heater accommodation part 8411. Specifically, the end portion of the right side of the first step part 8412*f*1 may be formed at a position that is lower than the first absorbent holder 861 by a height corresponding to the thickness of the outer edge part 8611 of the first absorbent holder 861.

Accordingly, a difference in the height of the upper end of the inlet IN1 of the heater accommodation part 8411 and the height of the lower end surface of the first absorbent holder 861 may be minimized, and flow loss may be minimized.

The second step part 8412*f*2 may be formed to protrude from the inner surface of the outer perimeter surface part 8412*b* under the upper surface part 8412*c* of the absorbent accommodation part 8412. At this time, the second step part 8412*f*2 may extend in parallel with the upper surface part 8412*c* of the absorbent accommodation part 8412, to correspond to the disposition structure of the second absorbent holder 862.

Additionally, as described in relation to the first absorbent holder 861, the second step part 8412*f*2 may be formed at a position that is lower than the 8412*c* by a height corresponding to the thickness from the upper surface part 8412*c* of the absorbent accommodation part 8412 to the outer edge part 8621 of the second absorbent holder 862.

Further, as illustrated in FIG. 15, the front end portion, i.e., the end portion of the right side, of the bottom surface part 8412*a* of the absorbent accommodation part 8412 may extend up to the inner portion of the heater accommodation part 8411 past the inlet IN2.

Accordingly, an air current F flowing in the heater housing 832 starts to collide with the bottom surface part 8412*a* of the absorbent accommodation part 8412 at least partially before passing through the outlet OUT1 of the heater accommodation space S1, in other words, before passing through the inlet IN2 of the absorbent accommodation part 8412, such that the flow direction of the air current starts to change.

As illustrated, a coupling groove 8412*a*1 to which a horizontal extension part of the heater bracket 8314 is coupled may be concavely provided at the front end portion side of the bottom surface part 8412*a* of the absorbent accommodation part 8412 extended up to the heater accommodation part 8411.

Further, the sub housing 842 may be coupled to the main housing 841 in such a way that the sub housing 842 surrounds the outer surface of the main housing 841 at least partially, to protect the main housing 841, and thermally insulate the inner space of the main housing 841 from the outside.

The sub housing 842, as illustrated, may be disposed in such a way that the sub housing 842 surrounds the outer perimeter surface and the bottom surface part 8411*b*, 8412*a* of the main housing 841 from the outside. Accordingly, the sub housing 842 may be functionally divided into a first accommodation part 842*a* and a second accommodation part 842*b* depending on an object to be disposed. However, as described in relation to the main housing 841, the first accommodation part 842*a* and the second accommodation part 842*b* may be integrally formed.

At this time, a gap may be formed between the inner surface of the sub housing 842 and the outer perimeter surface part and the bottom surface part 8411*b*, 8412*a* of the main housing 841.

For a gap to be formed between the sub housing 842 and the main housing 841, provided is a protrusion rib 8424, 8425 that protrudes toward the outer perimeter surface part and the bottom surface part 8411*b*, 8412*a* forming the outer surface of the main housing 841, and contacts the outer perimeter surface part and the bottom surface part 8411*b*, 8412*a* of the main housing 841.

Specifically, the protrusion rib 8424, 8425 may comprise an edge rib 8424 that is integrally provided at the outer edge of the sub housing 842.

As illustrated, the edge rib 8424 may continuously extend along the outer edge of the sub housing 842 and be shaped into a wall having an approximately uniform thickness.

As the sub housing 842 is coupled to the outer surface of the main housing 841, the end portion of the inside of the edge rib 8424 contacts the outer surface of the main housing 841. A height at which the edge rib 8424 protrudes from the inner surface of the sub housing 842 may remain uniform approximately uniformly such that a gap between the inner surface of the sub housing 842 and the inner surface of the main housing 841 may remain uniform entirely.

Additionally, in the case where the sub housing 842, as described hereinafter, is comprised of a first sub housing 842 and a second housing 842 that are provided in a segmented manner along the perpendicular surface of the sub housing 842, an edge rib 8242 may be further formed along a segmented line extending in the lengthwise direction of the sub housing 842.

Further, the sub housing 842 may be provided with at least one of open holes that is formed in such a way that the open hole penetrates from the inner surface to the outer surface of the sub housing 842.

For example, at least one of the open holes may comprise a pair of leg holes 8422*a* through which a pair of legs 8412*a*2 provided at the bottom surface part of the main housing 841 passes, a first open hole 8423*a* through which a thermistor 872 passes, and a second open hole 8423*b* which is formed to avoid another structure disposed around the moisture-absorbing and drying device 80.

The protrusion rib 8424, 8425 may further comprise a hole rib 8425 that extends along the edges of the leg hole 8422*a*, the first open hole 8423*a* and the second open hole 8423*b*.

The hole rib 8425 formed at the edges of the leg hole 8422*a*, the first open hole 8423*a* and the second open hole 8423*b* may protrude at a height the same as the height at which the edge rib 8424 protrudes.

The third separation space L3 acting as a heat insulation air layer may be formed between the sub housing 842 and the main housing 841 by the protrusion rib 8424, 8425 comprising the edge rib 8424 and the hole rib 8425, like the first separation space L1 acting as a heat insulation air layer between the heater housing 832 and the heater accommodation part 8411 of the main housing 841 described above. The third separation space L3 may be a closed space, i.e., an air pocket, closed by the edge rib 8424, the hole rib 8425, the inner surface of the sub housing 842, and the outer surface of the main housing 841.

Additionally, as the sub housing 842 is coupled to the main housing 841, the protrusion rib 8424, 8425 contacts the outer surface of the main housing 841. Accordingly, the thickness of the third separation space L3 may correspond to the height at which the protrusion rib 8424, 8425 protrudes from the inner surface of the sub housing 842.

The third separation space L3 may help to minimize an amount of heat delivered from the inside of the main housing 841 to the outside, and the temperature in the main housing 841 may help to maintain a temperature environment appropriate for an operation in the moisture absorbing mode or the absorbent reproducing mode. Thus, power consumption may be minimized, and time taken to dry wash targets and to reproduce the absorbent may decrease.

Figure 17:
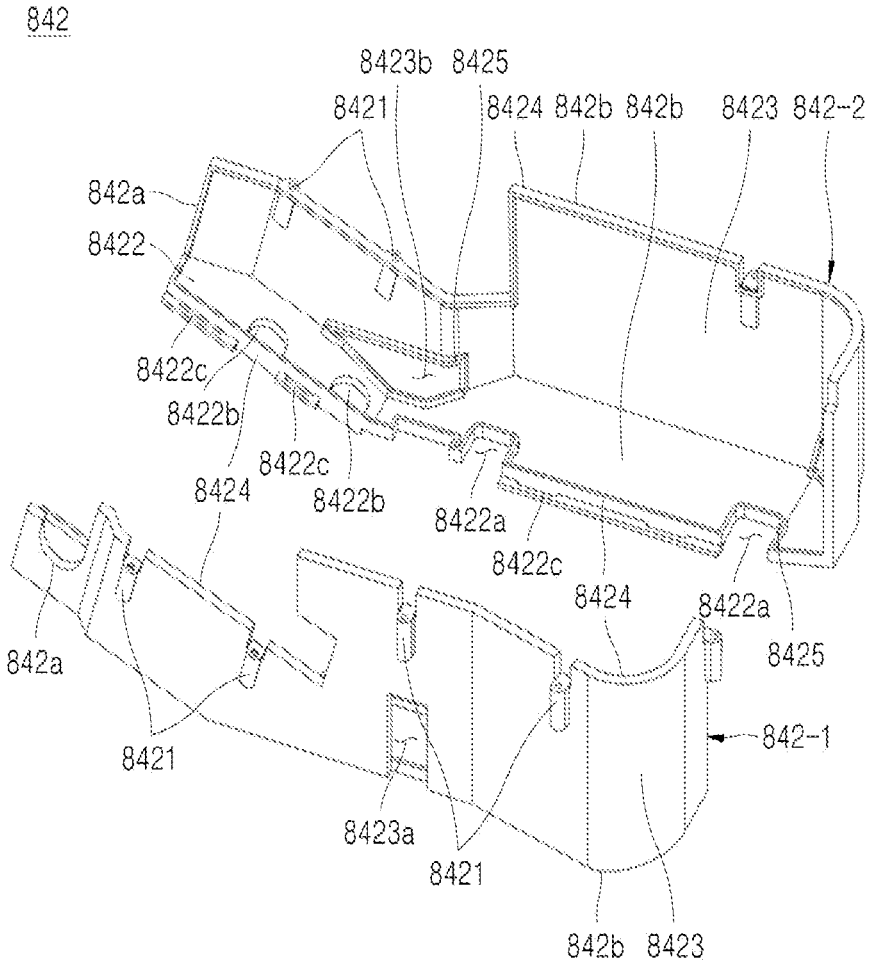
FIG. 17 and FIG. 18 are exploded perspective views showing a sub housing illustrated in FIG. 12.
Figure 18:
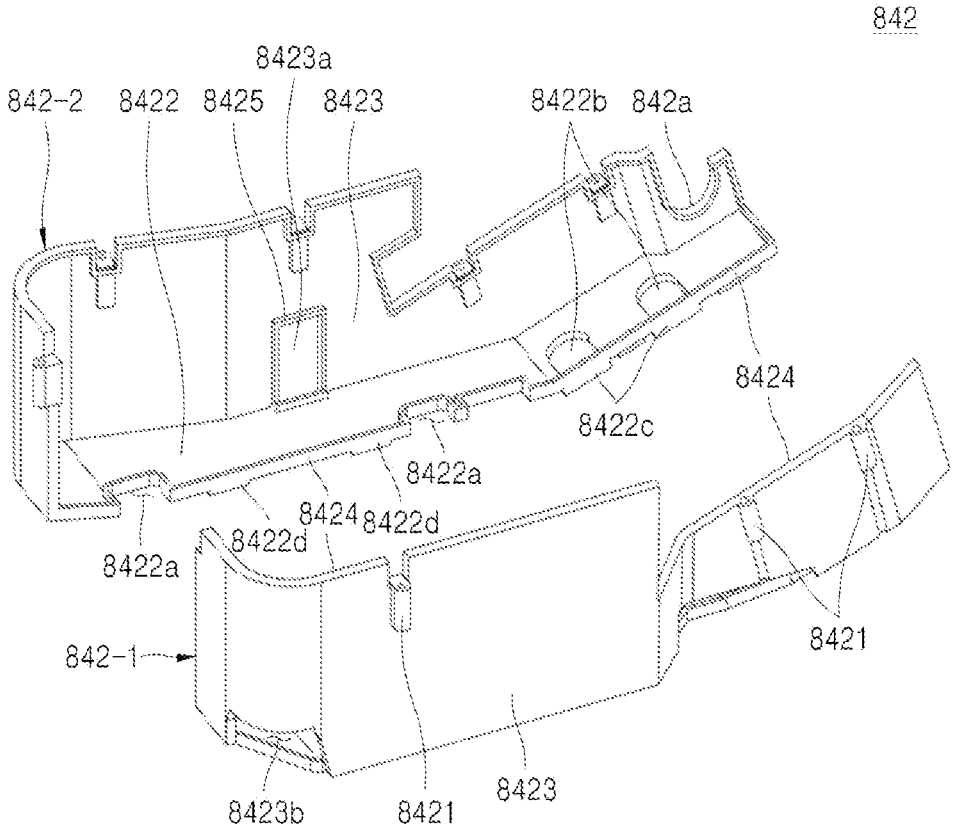

Further, the sub housing 842 may be provided as a segment that is segmented in the front-rear direction by a perpendicular surface considering ease of manufacturing and assembly, as illustrated in FIGS. 17 and 18.

The sub housing 842, as described above, may comprise a first sub housing 842-1 disposed at the front of the sub housing, and a second sub housing 842-2 disposed at the rear of the sub housing.

As illustrated, a segmented line may be formed at the bottom surface part 8422 and the left surface part of the outer perimeter surface part 8423, along the lengthwise direction of the sub housing 842, at the first sub housing 842-1 and the second sub housing 842-2.

A hook hole 8422*c* and a hook projection 8422*d* acting as a fastening means for fastening of the first sub housing 842-1 and the second sub housing 842-2 may be integrally provided along the segmented line, at the bottom surface part 8422 of the first sub housing 842-1 and the second sub housing 842-2.

The hook hole 8422*c*, for example, may be shaped into a rectangular hole that is open downward such that the hook projection 8422*d* having a rectangular cross section is inserted and coupled to the hook hole 8422*c*.

The hook projection 8422*d* may be shaped into a rib that protrudes downward. The hook projection 8422*d*, for example, may be a rib having a rectangular cross section.

In the illustrated embodiment, a total of four hook holes 8422*c* and a total of four hook projections 8422*d* are arranged, for example.

In the state where each of the hook projections 8422*d* is inserted into a corresponding hook hole 8422*c*, the first sub housing 842-1 and the second sub housing 842-2 may be fastened.

In the illustrated embodiment, the hook hole 8422*c* may be formed at the bottom surface part 8422 of the second sub housing 842, and the hook projection 8422*d* may be formed at the bottom surface part 8422 of the first sub housing 842. However, the positions of the hook hole 8422*c* and the hook projection 8422*d* are described as an example, and may be exchanged with each other.

Further, a groove part 8422*b* may be concavely formed at a position of the bottom surface part 8422 of the sub housing 842, which corresponds to the position of the bead groove 8411*b*1 of the main housing 841.

The groove part 8422*b* may have a size and shape appropriate for the bead groove 8411*b*1 of the main housing 841 to be inserted into the groove part 8422*b*.

Further, as described above, the open upper surface of the heater accommodation part 8411 of the main housing 841 and the open upper surface 8412*c* of the absorbent accommodation part 8412 of the main housing 841 may be closed by the cover 88.

For example, considering of the shape of the main housing 841, the cover 88 may comprise a first cover 881 coupled to the heater accommodation part 8411, and a second cover 882 coupled to the absorbent accommodation part 8412, as illustrated in FIG. 13 and FIG. 14.

The first cover 881 coupled to the heater accommodation part 8411 may comprise a cover main body 881*a* having a plate shape corresponding to the shape of the upper housing 8322 of the heater housing 832.

A pair of penetration holes may be formed at the cover main body 881*a* of the first cover 881 such that the above-described thermostat 871 may pass through the penetration hole 8811.

A ring-shaped second rib 8814 extending along the edge of the penetration hole 8811 may be provided under the penetration hole 8811.

As described above, a sealing ring 873 made of an elastic material may be provided between the penetration hole 8811 of the first cover 881 and the thermostat 871, to prevent leakage. The ring-shaped second rib 8814 may help to expand a surface area of contact with the sealing ring 873, such that airtight performance for the thermostat 871 improves.

Additionally, a plurality of fastening bosses 8812 for fastening to the main housing 841 and the sub housing 842 may be integrally provided on an outer perimeter surface 881*b* of the first cover 881. A fastening means such as a screw bolt and the like may extend by passing through the fastening boss 8812, and be screw-coupled to the fastening boss 8411*g* provided at the heater accommodation part 8411 of the main housing 841 or a fastening boss 8421 provided at the sub housing 842.

Additionally, a linear groove 8813 may be concavely formed at the lower end of the outer perimeter surface 881*b* of the first cover 881, and extend along the outer perimeter surface 881*b*.

At a time of fastening of the first cover 881, a coupling rib 8411*a*1 provided at the heater accommodation part 8411 may be inserted into the linear groove 8813, such that the leakage of an air current F between the first cover 881 and the heater accommodation part 8411 of the main housing 841 is minimized.

Additionally, a first rib 8815, as illustrated, may be integrally provided under the cover main body 881*a* of the first cover 881 and disposed at a position corresponding to the position of the second bead forming part 8322*b* of the heater housing 832.

The first rib 8815 may be provided in a ring shape to correspond to the second bead forming part 8322*b* shaped into a hemisphere surface.

As described above, at a time of fastening of the first cover 881, the second bead forming part 8322*b* is partially inserted into the first rib 8815. Accordingly, the second separation space L2 may be formed between the first cover 881 disposed at the upper side of the upper housing 8322 of the heater housing 832, and the upper housing 8322.

Further, since the inner diameter of the first rib 8815 is less than a maximum outer diameter of the first bead forming part 8321*b*, a surface area of contact between the first rib 8815 and the first bead forming part 8321*b* may be minimized. Accordingly, an amount of heat conducted between the first rib 8815 and the first bead forming part 8321*b* may be minimized.

Unlike the first cover 881, the second cover 882 coupled to the absorbent accommodation part 8412 may be shaped into a three-dimensional shape similar to an upside down funnel.

That is, the inner surface of the second cover 882 may be shaped into an upside down funnel that is convex upward such that air having passed though the absorbent 85 and the second absorbent holder 862 described above may converge.

Since the second cover 882 is provided with a convergence surface 8821 that is convex upward, a predetermined separation space S4 may be formed between the second absorbent holder 862 defining the upper end surface of the absorbent accommodation space S3, and the convergence surface of the second cover 882, and the separation space forms a flow path of discharge of air having passed through the absorbent 85. The discharge flow path is referred to as a third flow channel C3 since the discharge flow path is formed in succession of the second flow channel C2 formed between the pair of absorbent holders 86.

An outlet 8822 through which air having passed through the third flow channel C3 as a discharge flow path is discharged may be provided at an uppermost end of the convergence surface 8821 in the second cover 882.

At this time, the outlet 8822 may be formed at a position where the outlet 8822 is farthest from the inlet IN2 of the absorbent accommodation part 8412 with respect to the horizontal direction or the lengthwise direction of the absorbent accommodation part 8412. That is, in the state where the outlet 8822 is illustrated, the outlet 8822 may be formed closer to the left edge of the second cover 882 than to the right edge of the second cover 882.

As described hereinafter, the lower end of the connection duct part 883 guiding an air current F toward the lower surface 25 of the tub 20 may integrally connect to the outlet 8822.

Additionally, as described in relation to the first cover 881, a plurality of fastening bosses 8823 for fastening to the main housing 841 and the sub housing 842 may be integrally provided at the outer edge of the second cover 882. A fastening means such as a screw bolt and the like may extend by a passing through the fastening boss 8823 and be screw-coupled to the fastening boss 8412*g* provided at the absorbent accommodation part 8412 of the main housing 841 or the fastening boss 8421 provided at the sub housing 842.

Further, the moisture-absorbing and drying device 80 may further comprise a connection duct part 883 that connects to the outlet formed on the upper surface of the second cover 882 in a penetrating manner, and has an air passage therein.

As described above, the heating part 83, the air blowing part 82 and the absorbent 85 are disposed under the lower surface 25 of the tub 20. The connection duct part 883 guides an air current F discharged from the separation space S4 formed under the second cover 882 such that the air current F moves toward the air supply hole 254 formed on the lower surface 25 of the tub 20.

As illustrated in the embodiment, a duct main body 8831 of the connection duct part 883 may have a shape that may connect the air supply hole 254 of the tub 20 and the outlet of the heater housing 832, to guide an air current F.

For example, the lower end portion of the duct main body 8831 of the connection duct part 883 may fluid-communicate with the outlet of the second cover 882, and the upper end may extend in the upward direction U-direction and be shaped into a cylinder that passes through the air supply hole 254, as illustrated in FIG. 10 and FIG. 11.

Additionally, as a means of ensuring fastening efficiency and preventing leakage of water, a ring-shaped flange surface 8832 and a male screw part 8833 respectively may be integrally provided on the outer circumferential surface of the duct main body 8831.

The upper end portion of the duct main body 8831 may extend in the upward direction U-direction by passing through the lower surface 25 of the tub 20, and the upper end portion of the duct main body 8831 and the male screw part 8833 may at least partially protrude toward the inner portion of the tub 20 by passing through the lower surface 25 of the tub 20.

A fastening nut maybe coupled to the male screw part 8833 that is disposed bypassing through the inner portion of the tub 20.

At a time of fixing and fastening of the duct main body 8831, the fastening nut is screw-coupled to the male screw part 8833, in the tub 20, such that an upper end portion 8511 of the duct main body 8831 is fixed in the state of being exposed to the inner portion of the tub 20.

That is, in the state where the fastening nut closely contacts the upper side of the lower surface 25 of the tub 20, and the ring-shaped flange surface 8832 closely contacts the lower side of the lower surface 25 of the tub 20, the flange surface 8832 receives the force of being pulled toward the lower surface 25 of the tub 20, because of a coupling force of the fastening nut. Accordingly, an adhesive force between the flange surface 8832 and the lower surface 25 of the tub 20 increases. Thus, wash water is much less likely to leak from the outer circumferential surface of the duct main body 8831.

As a means of promoting the effect of preventing leakage of wash water, an airtight ring made of an elastic material may be further provided between the flange surface 8832 and the lower surface 25 of the tub 20.

In the case where the upper end portion 8511 of the duct main body 8831 is fixed to the tub 20 through the fastening nut as described above, the end portion side of the left side of the heater housing 832 is prevented from moving in the up-down direction U-D direction and is fixed by the duct main body 8831.

By doing so, a support structure for the upper side of the moisture-absorbing and drying device 80 may be ensured without an additional fastening means.

A support structure for the lower side of the moisture-absorbing and drying device 80 may be ensured through a plurality of legs that protrudes downward from the bottom surface part 8412*a* of the absorbent accommodation part 8412 of the main housing 841.

Additionally, a discharge guide 89 changing a discharge direction of an air current F supplied through the connection duct part 883 may be coupled to the upper end portion of the duct main body 8831.

Through the discharge guide 89, a direction of a portion of an air current F may change toward the lower surface 25 of the tub 20, and a direction of a portion of the air current F may change toward the upper surface 24 of the tub 20.

Further, the moisture-absorbing and drying device 80 may further comprise a suction duct 81 the front end potion of which connects to the air suction hole of the tub 20, the rear end portion of which connects to the air blowing part 82, and which guides a current F of air discharged from the tub 20 through the air supply hole 254 to the air blowing part 82.

Figure 7:
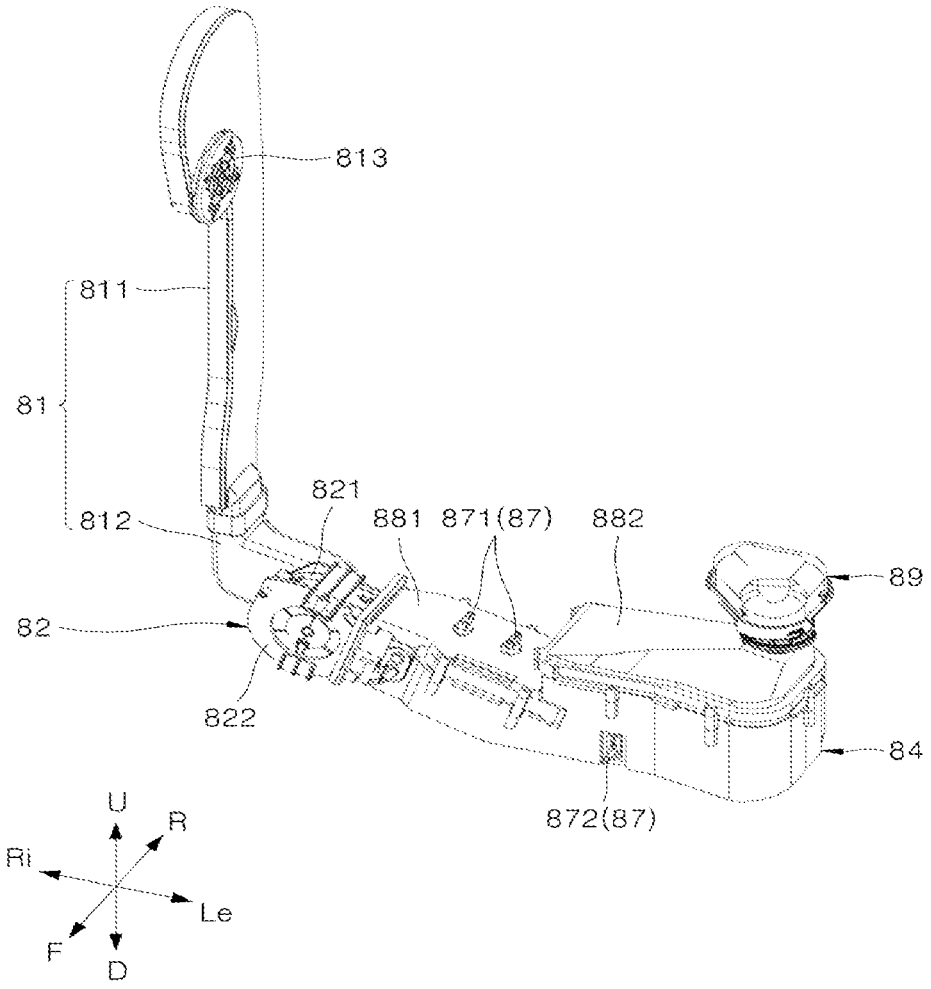
FIG. 7 is a front perspective view showing the moisture-absorbing and drying device of the dishwasher of one embodiment.
Figure 8:
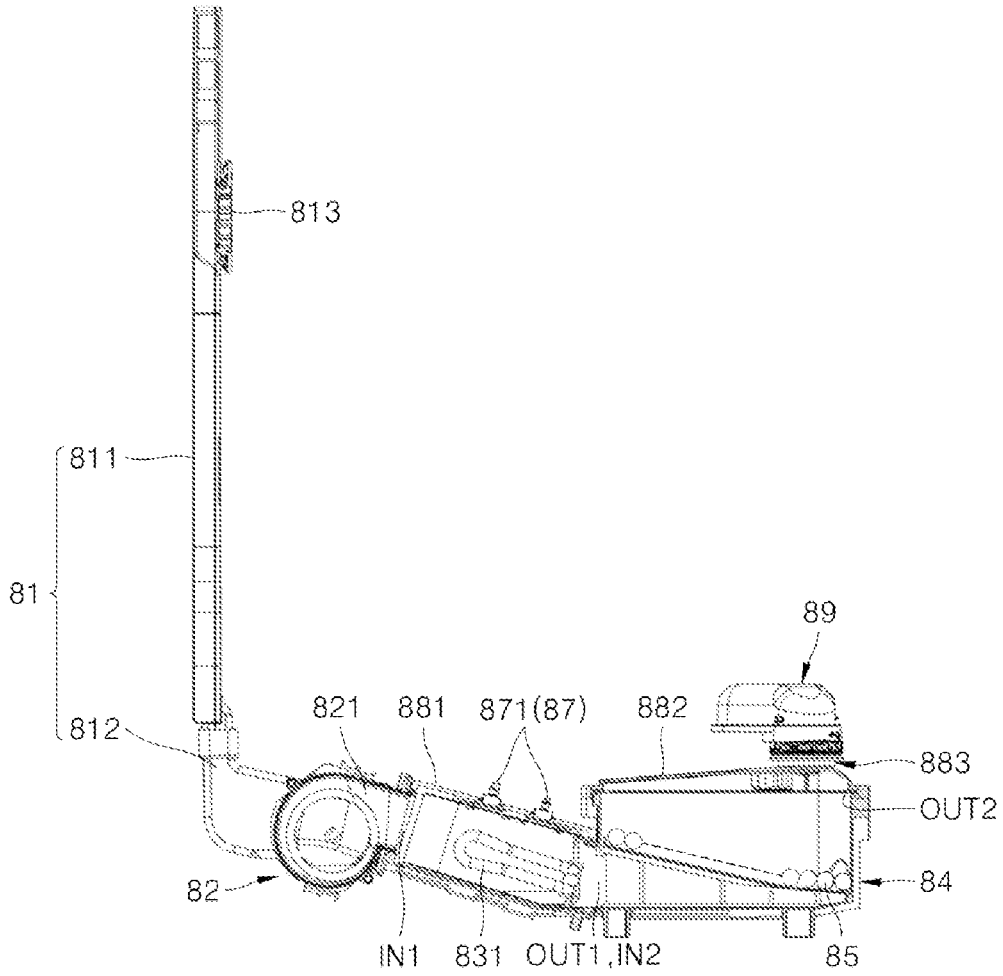
FIG. 8 is a cross-sectional view showing the moisture-absorbing and drying device illustrated in FIG. 7.

Specifically, the suction duct 81, as illustrated in FIG. 7 to FIG. 9, may comprise a main duct 811 that extends along the up-down direction and is disposed outside the right surface of the tub 20, and a sub duct 812 that is disposed under the lower surface 25 of the tub 20, between the rear end portion of the main duct 811 and the air blowing part 82.

The main duct 811 is disposed in contact with the right surface outside the right surface of the tub 20, and guides a current F of air suctioned through the air suction hole formed on the right surface of the tub 20 to a position under the lower surface 25 of the tub 20.

To this end, the main duct 811, as illustrated, may be disposed in such a way that the main duct extends as linear as possible, between the upper end thereof to the lower end thereof, along the up-down direction.

The inner portion of the main duct 811 may be shaped into a hollow hole, to form an air passage in which a current F of air may flow.

To embody the hollow hole shape easily and ensure ease of manufacturing, the main duct 811, as illustrated in FIG. 9, may be comprised of a first duct body 8111 and a second duct body 8112 that are provided as a segment segmented along a perpendicular surface, for example.

The first duct body 811 may be shaped into a box the left surface of which is open and which has a hollow hole, such that an upside down U-shaped air passage is formed in the first duct body 8111.

The hollow hole in the first duct body 8111 may be maintained. Accordingly, a reinforcement rib 8113 may be integrally provided on the right surface in the first duct body 8111 and extend from the right surface of the fist duct body to the left surface thereof along a direction where the air passage extends.

For example, the reinforcement rib 8113 may be disposed in such a way that the reinforcement rib 8113 segments the inner space of the first duct body 8111. Accordingly, the reinforcement rib 8113 may segment the air passage in the main duct 811 into two.

Additionally, the reinforcement rib 8113 extends from the upper end of an entrance 811*a* formed at the second duct body 8112 to an exit 811*b* of the main duct 811 along the air passage. Thus, the reinforcement rib 8113 may also serve as a blocking wall that helps to minimize the movement of wash water, drawn from the entrance 811*a* and scattered, toward the exit 811*b*.

The lower end portion of the first duct body 8111 may be open downward, and form a portion of the exit 811*b* through which a flow of air passes.

The second duct body 8112 is coupled to an open left surface of the first duct body 8111 and closes an air passage formed at the first duct body 8111.

To this end, the second duct body 8112 may have a plate shape corresponding to the shape of the open left surface of the first duct body 8111.

The second duct body 8112 may have an entrance 811*a* having a shape and a size corresponding to those of the air suction opening of the tub 20. As described above, a grille cap 813 may be fastened to the entrance 811*a*, to minimize an inflow of wash water and prevent an inflow of foreign substances.

The lower end portion of the second duct body 8112 may be open downward, and form the remaining portion of the exit 811*b* through which a current of air passes.

The lower end portion of the first duct body 811 and the lower end portion of the second duct body 8112 may be coupled to form the exit 811*b* of the main duct 811, and may connect to the sub duct 812 in such a way that the lower end portion of the first duct body 811 and the lower end portion of the second duct body 8112 are inserted into the entrance of the sub duct 812 described hereinafter. An airtight ring 814 made of an elastic material for preventing leakage may be disposed between the exit 811*b* of the main duct 811 and the entrance 812*a* of the sub duct 812.

The sub duct 812 is disposed between the lower end portion of the main duct 811 and the air blowing part 82, and changes a flow direction of an air current having passed through the exit 811*b* of the main duct 811 and guides the air current to the air blowing part 82.

Like the main duct 811, the sub duct 812 may have an air passage therein, and a current F of air having passed through the main duct 811 may flow through the air passage.

However, the sub duct 812 may have an air passage therein, and the air passage may extend in an L shape, to change a flow direction of air having passed through the main duct 811 and guide the air to a drawing opening of the fan housing 821 of the air blowing part 82.

Similarly, the outer shape of the sub duct 812 may have an L shape corresponding to the shape of the air passage in the sub duct 812.

An entrance 812*a* into which a current of air is drawn may be formed in one end portion, i.e., the upper end portion, of the L shape in the state where the L shape is illustrated, and an exit 812*b* may be formed in one end portion, i.e., the lower end portion, of the L shape in the state where the L shape is illustrated.

The entrance 812*a* of the sub duct 812 may have a rectangular cross section corresponding to the shape of the exit 811*b* of the main duct 811, and the exit 812*b* of the sub duct 812 may have a circular shape corresponding to the shape of a circular suction opening provided on the other lateral surface of the fan housing 821.

Additionally, as a means of fastening to the fan housing 821, a bridge part 8123 may be provided around the exit 812*b* of the sub duct 812.

Like the bridge part 8223 of the connecting bracket 822 described above, the bridge part 8123 of the sub duct 812 may have one end fixed to the upper side of the exit 812*b* of the sub duct 812 and the other end provided up to one lateral surface of the fan housing 821 and shaped into a rod.

A fastening hole may be provided at the other end of the bridge part 8123 of the sub duct 812, and a fastening means such as a screw bolt and the like may pass through the fastening hole and be fixed to one lateral surface of the fan housing 821.

[Detailed Configurations of Heat Insulation Structures of Heater Housing and Main Housing]

Figure 19:
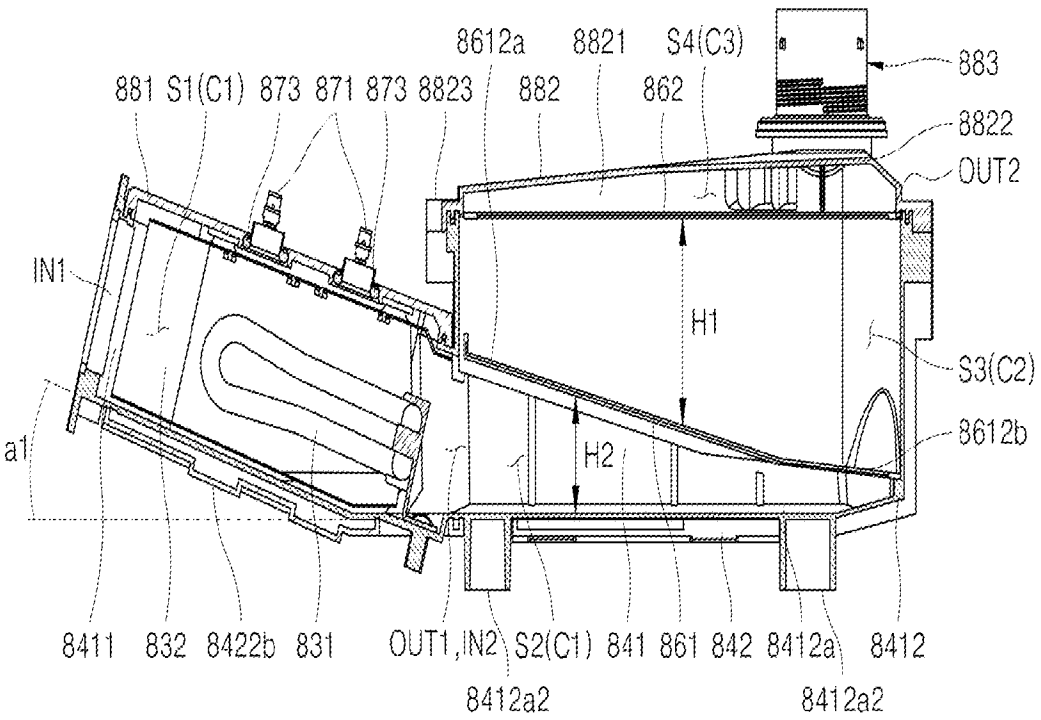
FIG. 19 is a cross-sectional view showing a configuration illustrated in FIG. 10, along line 19-19.
Figure 20:
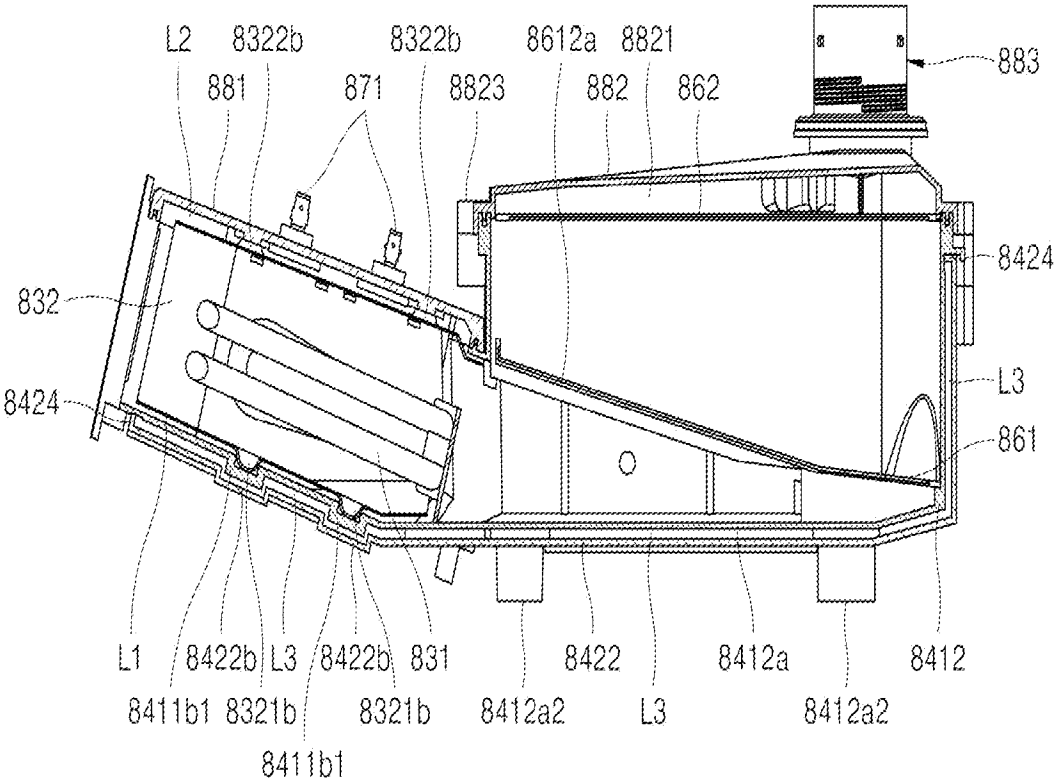
FIG. 20 is a cross-sectional view showing the configuration illustrated in FIG. 10, along line 20-20.
Figure 21:
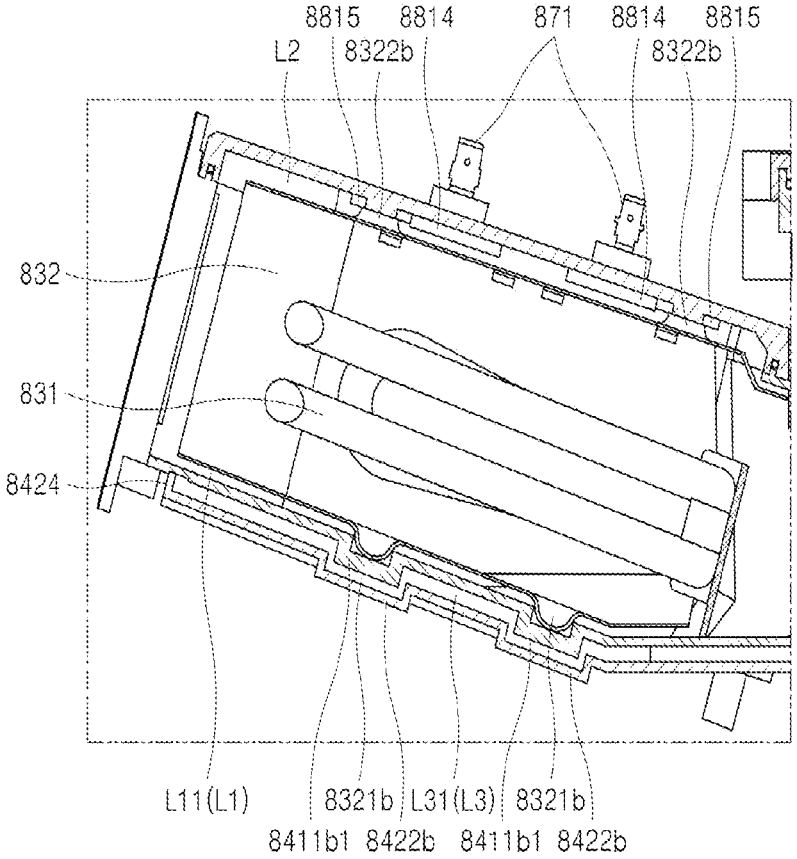
FIG. 21 and FIG. 22 are partially enlarged views of FIG. 20.
Figure 22:
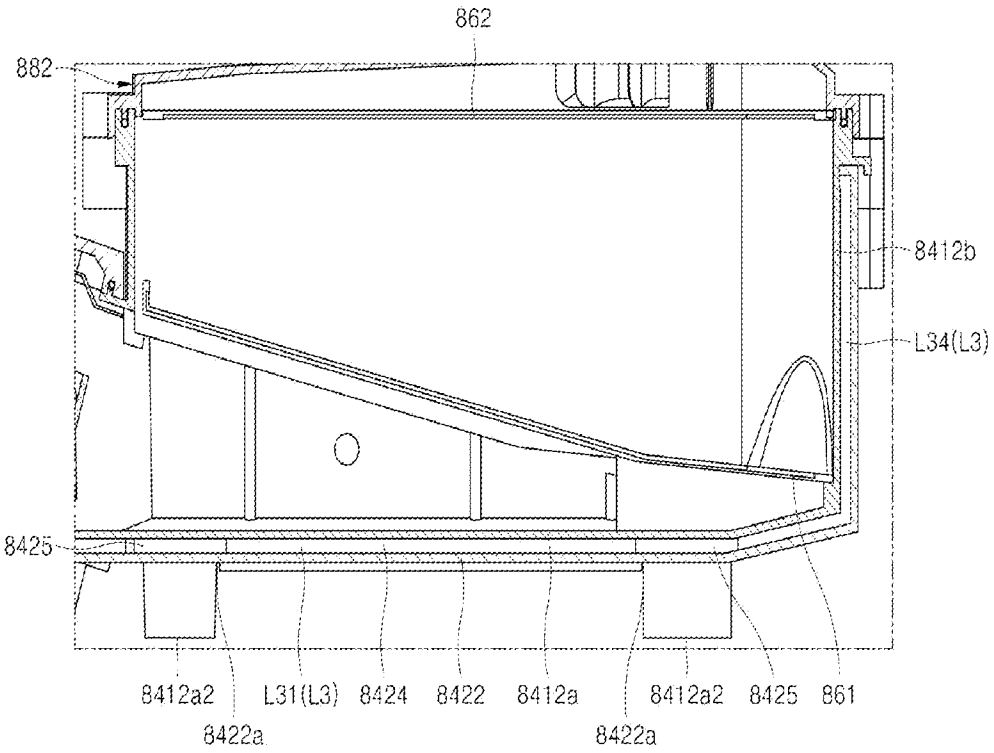
Figure 23:
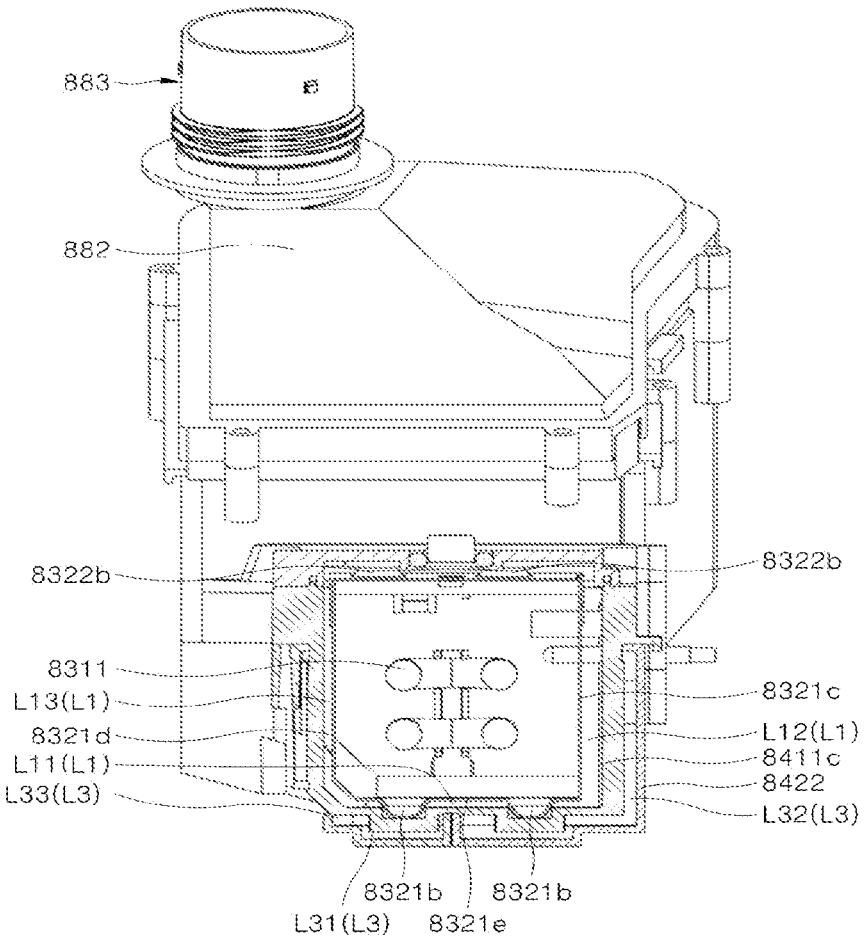
FIG. 23 is a cross-sectional view showing the configuration illustrated in FIG. 10, along line 23-23.

Hereinafter, a heat insulation structure provided at the moisture-absorbing and drying device 80 of the dishwasher 1 in one embodiment is described with reference to FIG. 19 and FIG. 23.

As described above, a first separation space L1 may be formed between the outer surface of the heater housing 832 and the outer surface of the main housing 841.

Specifically, the first separation space L1 may comprise a lower separation space L11.

The lower separation space L11 may be formed between the lower surface 8321*e* of the heater housing 832 and the bottom surface part 8411*b* of the heater accommodation part 8411 of the main housing 841.

As described above, a plurality of first bead forming parts 8321*b* protruding toward the bottom surface part 8411*b* of the heater accommodation part 8411 may be provided on the lower surface 8321*e* of the heater housing 832.

A bead groove 8411*b*1 may be provided at the bottom surface part 8411*b* of the heater accommodation part 8411 and concavely formed at a position corresponding to the position of each of the first bead forming parts 8321*b*.

A height at which each of the first bead forming parts 8321*b* protrudes may be greater than a depth at which a corresponding bead groove 8411*b*1 is depressed.

In the case where the heater housing 832 is disposed in the heater accommodation part 8411 completely, each of the first bead forming parts 8321*b* is partially inserted in to a corresponding bead groove 8411*b*1.

Accordingly, the lower surface 8321*e* of the heater housing 832 may be spaced upward from the bottom surface part 8411*b* of the heater accommodation part 8411 by a difference between the height at which the first bead forming part 8321*b* protrudes and the depth at which the first bead forming part 8321*b* is inserted into the bead groove 8411*b*1.

In the state where the lower surface 8321*e* of the heater housing 832 is spaced from the bottom surface part 8411*b* of the heater accommodation part 8411, a height between the lower surface 8321*e* of the heater housing 832 and the bottom surface part 8411*b* of the heater accommodation part 8411 that are formed approximately in parallel may remain constant, and the lower separation space L11 having a layer-shaped structure may be formed.

Additionally, the first separation space L1 may further comprise a front separation space L12 formed between the front surface 8321*c* of the heater housing 832 and the front surface part 8411*c* of the heater accommodation part 8411, and a rear separation space L13 between the rear surface 8321*d* of the heater housing 832 and the rear surface part 8411*d* of the heater accommodation part 8411.

The front surface 8321*c* of the heater housing 832 and the front surface part 8411*c* of the heater accommodation part 8411 may be spaced a predetermined distance apart from each other, approximately in parallel with each other, and the rear surface 8321*d* of the heater housing 832 and the rear surface part 8411*d* of the heater accommodation part 8411 may be spaced a predetermined distance apart from each other, approximately in parallel with each other.

Accordingly, the front surface 8321*c* of the heater housing 832 and the front surface part 8411*c* of the heater accommodation part 8411 may be formed in such a way that the front surface 8321*c* of the heater housing 832 and the front surface part 8411*c* of the heater accommodation part 8411 separate from each other entirely, and the front separation space L12 having a layer-shaped structure may be formed in the separation space.

Similarly, the rear surface 8321*d* of the heater housing 832 and the rear surface part 8411*d* of the heater accommodation part 8411 may be formed in such a way that the rear surface 8321*d* of the heater housing 832 and the rear surface part 8411*d* of the heater accommodation part 8411 separate from each other entirely, and the rear separation space L13 having a layer-shaped structure may be formed in the separation space.

Additionally, a second separation space L2 may be formed between the upper surface 8322*a* of the heater housing 832 and the cover main body 881*a* of the first cover 881.

As describe above, a plurality of second bead forming parts 8322*b* formed convexly upward may be formed on the upper surface 8322*a* of the heater housing 832.

A cylinder-shape second rib 8815 may be provided at the cover main body 881*a* of the first cover 881, protrude toward the upper surface 8322*a* of the heater housing 832, and be formed at a position corresponding to the position of each of the second bead forming parts 8322*b*.

Like the first bead forming part 8321*b*, each of the second bead forming parts 8322*b* may be inserted into a corresponding second rib 8815 at least partially.

Accordingly, the upper surface 8322*a* of the heater housing 832 may remain spaced from the cover main body 881*a* of the first cover 881 at least by a height at which the second bade forming part 8322*b* protrudes, and the second separation space L2 having a layer-shaped structure may be formed between the cover main body 881*a* of the first cover 881 and the upper surface 8322*a* of the heater housing 832.

At this time, the second separation space L2, as illustrated, may communicate with the upper ends of the front separation space L12 and the rear separation space L13 that constitute the first separation space L1.

Additionally, the lower separation space L11 constituting the first separation space L1 may communication with the lower end of the front separation space L12 and the lower end of the rear separation space L13.

Thus, the first separation space L1 and the second separation space L2 may communicate with each other, and form a heat insulation air layer surrounding the upper surface 8322*a*, the lower surface 8321*e*, the front surface 8321*c* and the rear surface 8321*d* of the heater housing 832.

As illustrated, the front end portion side of the heater housing 832 is formed at a position spaced toward a lower stream side from the right surface part 8411*f* at which the inlet IN1 of the heater accommodation part 8411 is formed. That is, the front end portion of the heater housing 832 is separate from the inlet IN1 of the heater accommodation part 8411.

Additionally, the rear end portion of the heater housing 832 may also be separate from the outlet OUT1 of the heater accommodation part 8411.

By doing so, the front end portion sides and the rear end portion sides of the first separation space L1 and the second separation space L2 may be exposed to the heater accommodation space, and at least a portion of an air current F generated based on an operation of the air blowing part 82 may be drawn into the first separation space L1 and the second separation space L2.

Accordingly, out of an air current F drawn into the heater accommodation part 8411, an air current D drawn into the heater housing 832 may be heated by directly exchanging heat with the heater main body 8311, and an air current F drawn into the first separation space L1 and the second separation space L2 may be heated by exchanging heat with the outer surface of the heater housing 832.

Accordingly, heat generated from the heater main body 8311 may be effectively delivered to an air current F, and heat released outward through the heater housing 832 may be absorbed by an air current F passing through the first separation space L1 and the second separation space L2, ensuring significant improvement in the heat insulation efficiency of the heater housing 832 and the heat generation efficiency of the heater main body 8311.

Additionally, a third separation space L3 may be formed between the outer surface of the main housing 841 and the outer surface of the sub housing 842.

As illustrated, the sub housing 842 may be disposed to surround the bottom surface part 8411*b*, 8412*a* and the outer perimeter surface part of the main housing 841.

At this time, the sub housing 842 may be formed to have an inner surface of a shape corresponding to the shapes of the bottom surface part 8411*b*, 8412*a* and the outer perimeter surface part of the main housing 841.

However, a predetermined gap may be formed between the inner surface of the sub housing 842 and the outer perimeter surface part and the bottom surface part 8411*b*, 8412*a* of the main housing 841.

A gap between the sub housing 842 and the main housing 841 may be formed through a protrusion rib 8424, 8425 that protrudes toward the outer surface of the main housing 841 and contacts the outer perimeter surface part and the bottom surface part 8411*b*, 8412*a* of the main housing 841.

As described above, the protrusion rib 8424, 8425 may comprise an edge rib 8424 provided integrally at the outer edge of the sub housing 842, a leg hole 8422*a* formed in such a way that penetrates the sub housing 842, and a hole rib 8425 extended along the edges of the first open hole 8423*a* and the second open hole 8423*b*.

Heights at which the edge rib 8424 and the hole rib 8425 protrude may be the same. Accordingly, a gap between the sub housing 842 and the main housing 841 may be the heights at which the edge rib 8424 and the hole rib 8425 protrude.

The third separation space L3 acting as a heat insulation air layer may be formed between the sub housing 842 and the main housing 841, by the protrusion rib 8424, 8425 comprising the edge rib 8424 and the hole rib 8425.

At this time, the third separation space L3 may be a closed space, i.e., an air pocket, closed by the edge rib 8424, the hole rib 8425, the inner surface of the sub housing 842 and the outer surface of the main housing 841.

As illustrated, the third separation space L3 may comprise a lower separation space L31 formed under the main housing 842, a front separation space L32 formed at the front of the main housing 841, a rear separation space L33 formed at the rear of the main housing 841, and a side separation space L34 formed on the left surface of the main housing 841.

At this time, in the case where the sub housing 842 is segmented into a first sub housing 842-1 and a second sub housing 842-2 as described above, the lower separation space L31 and the side separation space L34 may be provided in such a way that the lower separation space L31 and the side separation space L34 are segmented along the first sub housing 842-1 and the second sub housing 842-2.

At this time, the lower separation space L31, the front separation space L32, and the side separation space L34 formed in/at the first sub housing 842-1 communicate with one another to form one front air pocket, and the lower separation space L31, the rear separation space L33 and the side separation space L34 formed in the second sub housing 842-2 communicate with one another to form one rear air pocket.

Since a plurality of separation spaces having a maximum size communicate with one another to form a maximum air pocket as described above, a decrease in the heat insulation capacity of the air pocket may be prevented, and heat insulation performance may be maintained to a maximum degree.

The moisture-absorbing and drying device 80 of the dishwasher 1 in one embodiment may ensure the heat insulation structures for the heater housing 832 and the absorbent accommodation part 8412 at the same time through a single sub housing 842. Accordingly, a heat insulation structure for the heater housing 832 and the absorbent 85 may be embodied without an additional heat insulation material, thereby reducing manufacturing costs significantly and simplifying manufacturing processes significantly.

According to the present disclosure, the first separation space L1 may be formed between the heater housing 832 and the heater accommodation part 8411 of the main housing 841, and the third separation space L3 may be formed between the heater accommodation part 8411 of the main housing 841 and the sub housing 842, to act as a double air pocket around the heater 831.

Figure 24A:
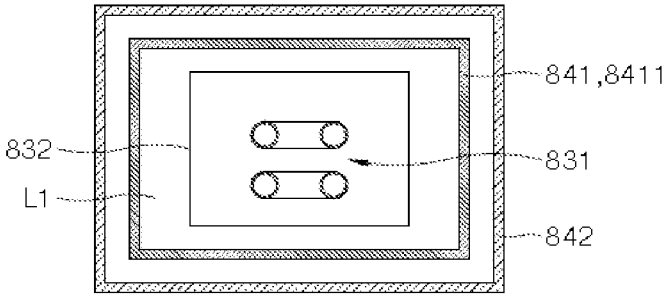
FIGS. 24A through 24C are schematic cross-sectional views for describing embodiments without at least one of a heater housing and a sub housing.

FIG. 24A is a schematic cross-sectional view for describing a state where the first separation space L1 and the third separation space L3 are formed around the heater 831 as described above.

However, the moisture-absorbing and drying device 80 of one embodiment is not limited, and at least any one of the heater housing 832 and the sub housing 842 may be omitted.

Figure 24B:
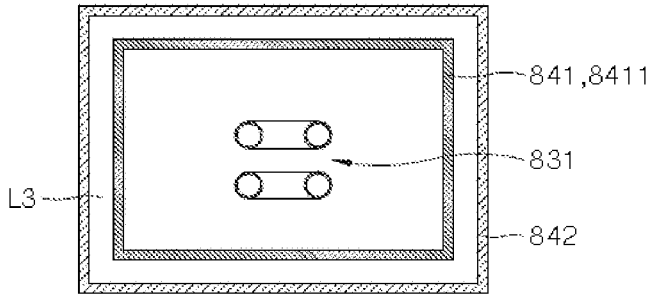
Figure 24C:
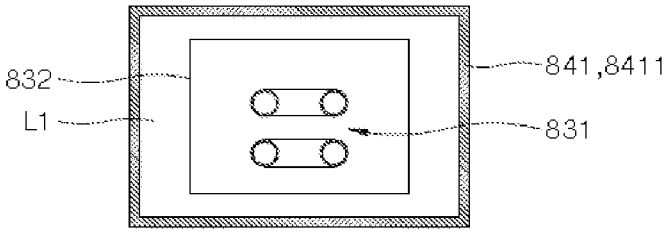

FIG. 24B is a schematic cross-sectional view showing an embodiment without the heater housing 832, and FIG. 24C is a schematic cross-sectional view showing an embodiment without the sub housing 842.

Since at least anyone of the heater housing 832 and the sub housing 842 is omitted as described above, the moisture-absorbing and drying device 80 of one embodiment may ensure a reduction in manufacturing costs and manufacturing time.

However, in the case where at least any one of the heater housing 832 and the sub housing 842 is omitted as described above, the first separation space L1 and the third separation space L3 forming an air pocket may also be omitted.

Thus, any one of the first separation space L1 and the third separation space L3 is omitted, causing a deterioration in thermal insulation for the heater 831 and heat generation efficiency of the heater 831.

Figure 25:
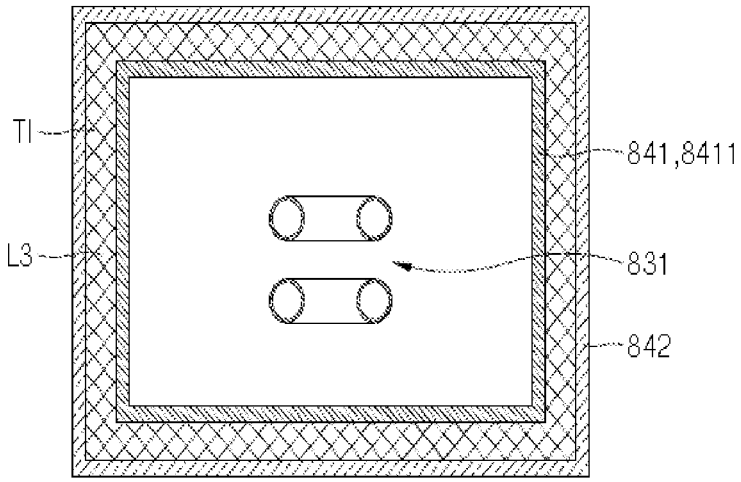
FIG. 25 is a schematic cross-sectional view for describing an embodiment of a third separation space of FIG. 24B, filled with an insulation material.

To prevent a deterioration in thermal insulation for the heater 831 and heat generation efficiency of the heater 831, any one of the first separation space L1 and the third separation space L3 may be filled with a heat insulation material TI, as illustrated in FIG. 25.

FIG. 25 shows an embodiment without the heater housing 832, for example.

Accordingly, the first separation space L1 between the heater housing 832 and the heater accommodation part 8411 of the main housing 841 is omitted.

At this time, the third separation space L3 between the heater accommodation part 8411 of the main housing 841 and the sub housing 842 may be filled with a heat insulation material TI, as illustrated.

The sort of an applicable heat insulation material TI is not limited, but a heat insulation material TI that is easily molded and relatively lightweight may be selected considering the shape of the third separation space L3.

An addition of the heat insulation material TI may help to effectively compensate for a deterioration in thermal insulation for the heater 831 and heat generation efficiency of the heater 831, which may be caused due to the omission of the heater housing 832 and the first separation space L1.

Though not illustrated, in the case where the sub housing 842 and the third separation space L3 are omitted as illustrated in FIG. 24C, a heat insulation material TI may be added to the first separation space L1, and this configuration is to be included in the scope of the subject matter of the present disclosure.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

DESCRIPTION OF REFERENCE NUMERALS

| | |
|---|---|
| 1: Dishwasher | 10: Case |
| 20: Tub | 30: Door |
| 40: Driving part | 50: Storage part |
| 60: Spray part | 80: Moisture-absorbing and drying device |
| 90: Base | |

What is claimed is:

1. A dishwasher, comprising:

a tub that defines a wash space configured to accommodate one or more objects to be washed; and a moisture-absorbing and drying device configured to absorb moisture from air discharged from the tub and to supply the air to the tub, wherein the moisture-absorbing and drying device comprises:

an air blowing fan configured to generate an air current of the air, an absorbent disposed downstream relative to the air blowing fan in a flow direction of the air current, a heater disposed between the air blowing fan and the absorbent in the flow direction of the air current, the heater being configured to heat the air current to be supplied to the absorbent, a heater housing that accommodates the heater, and a main housing that accommodates the heater housing and the absorbent, wherein the heater housing is spaced apart from an inner surface of the main housing to thereby define a first separation space between the heater housing and the inner surface of the main housing, and wherein the heater housing comprises a lower bead that protrudes from a lower surface of the heater housing toward a bottom surface of the main housing, the lower bead being configured to support the lower surface of the heater in a state where the lower surface of the heater housing is spaced apart from the bottom surface of the main housing.

2. The dishwasher of claim 1, wherein the first separation space comprises a lower separation space that is defined between the lower surface of the heater housing and the bottom surface of the main housing.

3. The dishwasher of claim 1, wherein the main housing defines a bead groove that is recessed from the bottom surface of the main housing and receives the lower bead.

4. The dishwasher of claim 1, wherein the first separation space comprises a front separation space that is defined between a front surface of the heater housing and a front surface of the main housing.

5. The dishwasher of claim 1, wherein the first separation space comprises a rear separation space defined between a rear surface of the heater housing and a rear surface of the main housing.

6. The dishwasher of claim 1, wherein the moisture-absorbing and drying device further comprises a cover disposed at an upper side of the heater housing and coupled to an open upper surface of the main housing, wherein the cover is spaced apart from an upper surface of the heater housing to thereby define a second separation space between the cover and the upper surface of the heater housing, and wherein the second separation space is in fluid communication with the first separation space.

7. The dishwasher of claim 6, wherein the heater housing comprises an upper bead that protrudes from the upper surface of the heater housing toward the cover, and wherein the upper bead separates the upper surface of the heater housing from the cover.

8. The dishwasher of claim 7, wherein the cover comprises a first rib that has a ring shape and receives the upper bead, the first rib protruding toward the upper surface of the heater housing.

9. The dishwasher of claim 8, wherein the moisture-absorbing and drying device further comprises a thermostat configured to sense an overheating of the heater, wherein the cover defines a penetration hole that receives the thermostat, and wherein the cover further comprises a second rib that extends along an edge of the penetration hole and protrudes toward the upper surface of the heater housing, the second rib being disposed at a lower portion the penetration hole.

10. The dishwasher of claim 9, wherein the moisture-absorbing and drying device further comprises a sealing ring that is made of an elastic material and provided between the penetration hole and the thermostat.

11. The dishwasher of claim 1, wherein the moisture-absorbing and drying device further comprises a sub housing that is coupled to the main housing, and wherein the sub housing is spaced apart from an outer surface of the main housing to thereby define a third separation space between the sub housing and the outer surface of the main housing.

12. The dishwasher of claim 11, wherein the sub housing comprises a protrusion rib that protrudes from an inner surface of the sub housing toward the outer surface of the main housing and contacts the outer surface of the main housing, and wherein the protrusion rib defines a height of the third separation space corresponding to a length of the protrusion rib protruding from the inner surface of the sub housing toward the outer surface of the main housing.

13. The dishwasher of claim 12, wherein the third separation space is a closed space that is defined by the protrusion rib, the inner surface of the sub housing, and the outer surface of the main housing.

14. A dishwasher, comprising:

a tub that defines a wash space configured to accommodate one or more objects to be washed; and a moisture-absorbing and drying device configured to absorb moisture from air discharged from the tub and to supply the air to the tub, wherein the moisture-absorbing and drying device comprises:

an air blowing fan configured to generate an air current of the air, an absorbent disposed downstream relative to the air blowing fan in a flow direction of the air current, and a double structure that accommodates the absorbent, the double structure comprising (i) a main housing that accommodates the absorbent and (ii) a sub housing coupled to an outer surface of the main housing, wherein a least a portion of the sub housing is spaced apart from the main housing to thereby define a separation space between the main housing and the sub housing, wherein the sub housing comprises a protrusion rib that protrudes from an inner surface of the sub housing toward the outer surface of the main housing and contacts the outer surface of the main housing, and wherein the protrusion rib defines a height of the separation space corresponding to a length of the protrusion rib protruding from the inner surface of the sub housing toward the outer surface of the main housing.

15. The dishwasher of claim 14, wherein the moisture-absorbing and drying device further comprises a heater accommodated in the double structure and disposed between the air blowing fan and the absorbent in the flow direction of the air current, the heater being configured to heat the air current to be supplied to the absorbent.

16. The dishwasher of claim 15, wherein the moisture-absorbing and drying device further comprises a heater housing that accommodates the heater and is disposed in the main housing, and wherein at least a portion of the heater housing is spaced apart from the main housing to thereby define an inner separation space between the heater housing and the main housing.

17. A dishwasher, comprising:

a tub that defines a wash space configured to accommodate one or more objects to be washed; and a moisture-absorbing and drying device configured to absorb moisture from air discharged from the tub and to supply the air to the tub, wherein the moisture-absorbing and drying device comprises:

an air blowing fan configured to generate an air current of the air, an absorbent disposed downstream relative to the air blowing fan in a flow direction of the air current, a heater disposed between the air blowing fan and the absorbent in the flow direction of the air current, the heater being configured to heat the air current to be supplied to the absorbent, and a triple structure comprising (i) a heater housing that accommodates the heater, (ii) a main housing that accommodates the heater housing, and (iii) a sub housing coupled to an outer surface of the main housing.

18. The dishwasher of claim 17, wherein the moisture-absorbing and drying device further comprises an absorbent holder that is configured to, together with the heater housing in the main housing, restrict the absorbent from escaping from the main housing, and wherein the absorbent holder and the absorbent are accommodated in a double structure that is defined by the main housing and the sub housing.

19. The dishwasher of claim 17, wherein the main housing is disposed between the heater housing and the sub housing, and wherein the outer surface of the main housing is in contact with an inner surface of the sub housing, and an inner surface of the main housing faces an outer surface of the heater housing.

* * * * *